United States Patent [19]

Durell

[11] 4,253,255

[45] Mar. 3, 1981

[54] AUTOMATED DREDGING WITH VACUUM ASSIST

[76] Inventor: William E. Durell, P.O. Box 250 - R. 5, Antioch, Ill. 60002

[21] Appl. No.: 1,822

[22] Filed: Jan. 8, 1979

Related U.S. Application Data

[63] Continuation-in-part of Ser. No. 835,333, Sep. 21, 1977, abandoned, which is a continuation-in-part of Ser. No. 632,294, Nov. 17, 1975, abandoned.

[51] Int. Cl.[3] ..... E02F 3/88

[52] U.S. Cl. ..... 37/62; 37/59; 37/72; 37/195; 417/125

[58] Field of Search ..... 37/58, DIG. 8, 195, 37/59, 61–63; 417/125, 123, 122

[56] References Cited

U.S. PATENT DOCUMENTS

| | | | |
|---|---|---|---|
| 474,338 | 5/1892 | Dyer | 417/125 |
| 835,391 | 11/1906 | Allison | 417/125 |
| 1,000,713 | 8/1911 | Callow | 417/125 |
| 2,669,941 | 2/1954 | Stafford | 417/125 |
| 2,678,203 | 5/1954 | Huff | 37/63 X |
| 3,005,417 | 10/1961 | Swaney | 417/125 |
| 3,552,884 | 1/1971 | Faldi | 417/122 |
| 3,753,303 | 8/1973 | Holzenberger et al. | 37/58 |
| 3,842,521 | 10/1974 | Faldi | 37/59 X |

*Primary Examiner*—Clifford D. Crowder

*Attorney, Agent, or Firm*—Kinzer, Plyer, Dorn & McEachran

[57] ABSTRACT

A pressure displacement dredging system capable of effective and efficient operation, without surging, over a wide depth range and under varying bottom conditions, comprises a submersible dredging head including at least three pressure vessels each having a material intake port and a material discharge port with appropriate check valves, each having an inlet port for air or other operating fluid connected to a high pressure fluid source through an inlet valve and each having an operating fluid exhaust port vented to the atmosphere through an exhaust valve. The system provides cycle control means, actuated by low level sensors in each pressure vessel, which actuates the vessels between discharge and filling phases in a predetermined closed sequence; when the level of material in a first discharging vessel drops below the low level sensor the cycle control opens the inlet valve and closes the exhaust valve for the next vessel in the sequence to initiate pressure displacement discharge of material from that next vessel, and thereafter closes the inlet valve and opens the exhaust valve of the first vessel so that the first vessel fills by pressure displacement, the sequence being such that each pressure vessel is full before discharge of that vessel is initiated. One modification of the system provides a vacuum assist for dredging in extremely shallow conditions.

6 Claims, 17 Drawing Figures

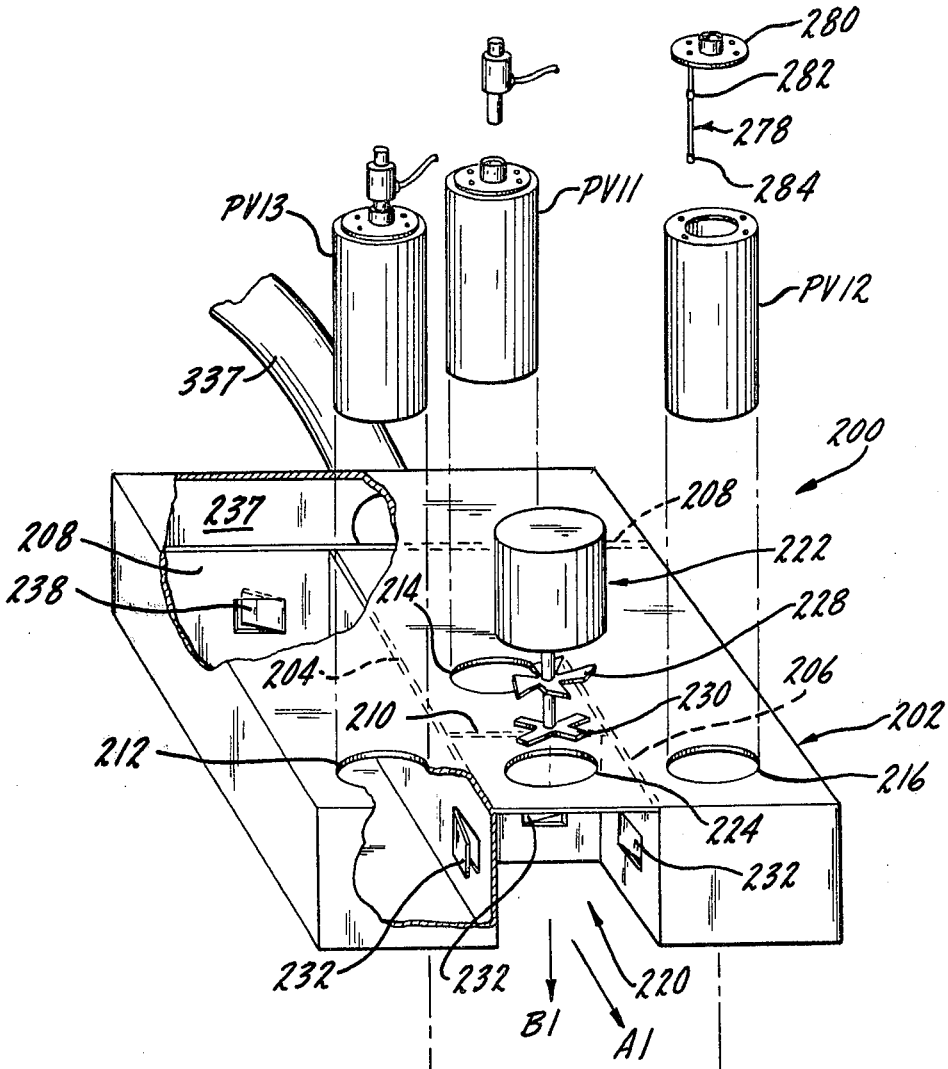
FIG. 12.
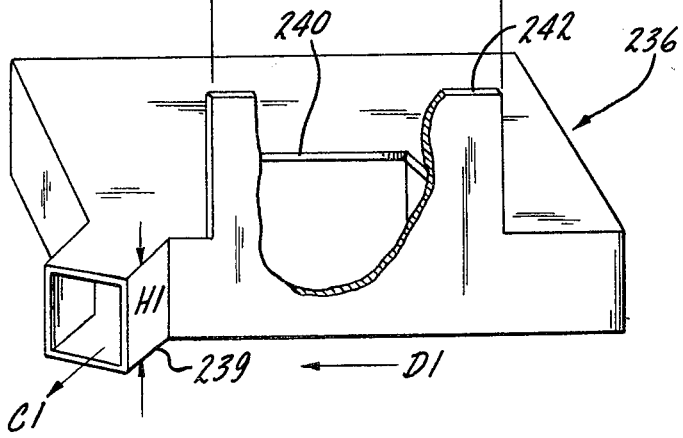

EXHAUST
HIGH PRESSURE AIR
CONTROL VALVE (ON)
START
MANUAL PILOT RELEASE
PILOT RELEASE
FILL CUTOFF
INLET
OPEN
CLOSE
EXHAUST
OPEN
CLOSE
(DISCHARGING)
(FULL)
(FILLING)
FULL PROBE
DISCHARGE PROBE
PV1
PV2
PV3
DISCHARGE SEQUENCE: PV1 - PV2 - PV3 - PV1 - PV2 ....
OFF
B+

AUTOMATED DREDGING WITH VACUUM ASSIST

CROSS REFERENCE TO RELATED APPLICATIONS

This application is a continuation-in-part of a prior application Ser. No. 835,333 filed Sept. 21, 1977, which prior application was a continuation-in-part of application Ser. No. 632,294 filed Nov. 17, 1975 both of the foregoing applications are now abandoned.

BACKGROUND OF THE INVENTION

Pneumatic and hydraulic pressure displacement dredging systems employ pressure vessels which are lowered into an operating position immediately adjacent the bottom of a lake, pond, stream, or other body of water where dredging is required. A pressure vessel is first filled with material from the bottom by venting the vessel so that water and entrained solids flow into the vessel, by hydrostatic displacement, through an intake port in its base. Subsequently, air or some other operating fluid is introduced into the top of the vessel under high pressure to discharge the material, through an outlet port located near the vessel bottom, into a spoil pipe or other material discharge conduit. Subsequently, the high pressure fluid is exhausted from the vessel and bottom material again flows into the pressure vessel to begin another pumping cycle.

A pressure displacement dredging system using a single pressure vessel is subject to highly undesirable surges in operation, caused by the alternating filling and discharge cycles. Furthermore, a single-vessel pressure displacement dredge is slow and inefficient in operation because the duty cycle is only about fifty percent.

The inefficiency of a single vessel pump is avoided in the pump described in Callow U.S. Pat. No. 1,000,713, which incorporates two pneumatic pressure vessels operating in alternation in a single pumping system. When a first vessel is filled, a level sensor in that vessel closes its vent and opens a high pressure air inlet to begin discharging material. The level sensor also shuts off the high pressure air supply to a second vessel and opens its vent so that discharge of material from the second vessel is initiated and replaces the interrupted discharge from the first vessel.

In the Callow pumping system, however, surging can still occur during changeover from one pressure vessel to the other. If the vessels fill faster than they discharge, the changeover between vessels occurs without emptying the vessels and the cumulative effect leads to stalling of the system with both pressure vessels filled. If the vessels fill slower than they discharge, high pressure air may be wasted in each cycle while one vessel is empty but must wait for the other to fill, a generally inefficient arrangement.

Another pumping system, which provides some improvement over the Callow patent, is described in Stafford U.S. Pat. No. 2,669,941. Stafford provides level sensors at both the top and the bottom of two pressure vessels. When the material in a first vessel falls below its lower sensor, during discharge, the air inlet to the second vessel is opened and its vent is closed to initiate discharge. At the same time, the air inlet to the first vessel is closed; its vent is opened after a predetermined time delay. This effectively minimizes surging if one vessel fills before the other is completely discharged. On the other hand, if one vessel does not fill before the other is emptied, then changeover between vessels occurs with only a partially filled vessel available for continuing discharge. On each subsequent cycle, the vessels fill to progressively lower levels; the control cycles between the two vessels at an increasingly rapid rate that becomes highly inefficient and leads to an effective stallout, with excessive wear on the system. Moreover, if conditions are such that one vessel does not fill before the other is emptied, surging is again encountered.

It is highly desirable that a dredge be capable of operation in a wide variety of varying conditions, particularly with respect to the depth of the lake, stream, pond, or other body being dredged. Thus, the hydrostatic head at the material intake ports of the pressure vessels may vary over a wide range. With prior art control systems, particularly those referred to above, in which effective operation is dependent upon the relation between the filling and discharge rates of the pressure vessels, the depth range for the dredge is severely limited and many of the potential advantages of the pressure displacement pumping apparatus cannot be effectively realized. In particular, for effective dredging operations it is essential that a filled pressure vessel always be available to begin discharge whenever one of the other pressure vessels in the system approaches empty condition.

In very shallow streams and ponds, and in swampy areas, known pressure displacement pumps may be impractical for dredging because they are dependent upon hydrostatic pressure to fill the pressure vessels. Thus, if the body being dredged has a depth even minimally less than the height of the pressure vessels, the vessels fill very slowly and cannot be filled completely. Indeed, filling of the vessels is usually too slow for efficient operation unless a substantial head, well above the height of the pressure vessels, is available. On the other hand, if this difficulty is overcome, pressure displacement dredges can be more effective and efficient than mechanical dredges in swamps and other shallow bodies of water as well as in deeper bodies.

SUMMARY OF THE INVENTION

Accordingly, it is an object of the present invention to provide a new and improved pressure displacement dredging system, incorporating automated controls, that effectively minimizes or eliminates the problems and difficulties of previously known systems as generally described above.

Another object of the invention is to provide a new and improved pressure displacement dredging system that is efficiently and effectively operable within a wide range of varying depths, under automated control, without surging and without requiring modification of the control to compensate for variations in depth conditions.

An additional object of the invention is to provide a new and improved pressure displacement dredging system, having automated controls and operable over a wide range of varying depths, that is simple in design and construction and small enough to be fully portable.

An additional object of the invention is to provide a new and improved pressure displacement dredging system, incorporating automated controls, that is capable of functioning with only a minimal pressure head, even less than the pressure vessel height.

Accordingly, the invention relates to a pressure displacement dredging system operable over a wide depth range under varying bottom conditions and comprising a submersible dredging head including a plurality of at least three pressure vessels, each vessel having a material intake port and a material discharge port, each material port including a check valve, and each vessel having an operating fluid inlet port and an operating fluid exhaust port, the material discharge ports of all of the vessels being connected to a common material discharge conduit. A corresponding plurality of low level sensors, one in each pressure vessel, are provided, as well as a source of operating fluid, under pressure, an inlet valve for each pressure vessel, connecting the inlet port of the vessel to the operating fluid source, and an exhaust valve for the exhaust port of each pressure vessel. A vacuum pump is provided; the exhaust port of each pressure vessel is connected to the vacuum pump through a vacuum exhaust valve. The system further comprises cycle control means coupled to the level sensors and to the inlet, exhaust and vacuum exhaust valves of all of the vessels in a predetermined closed sequence, the cycle control means being responsive to sensing of the absence of material at the low level sensor in a first vessel to open the inlet valve for the next vessel in the sequence and initiate pressure displacement discharge of material therefrom; immediately thereafter, the cycle control means closes the inlet valve and opens the exhaust valve of the first vessel to initiate filling of the first vessel by pressure displacement. The cycle control means further includes vacuum changeover means for closing the exhaust valve and opening the vacuum exhaust valve of each pressure vessel during its filling phase to accelerate and complete filling of the vessel when dredging in shallow depths. The operating sequence is such that each pressure vessel is full when the material in the preceding vessel in the sequence has discharged to the level of its low level sensor.

BRIEF DESCRIPTION OF THE DRAWINGS

FIG. 15 is a schematic diagram of a combined pneumatic and electrical control system for another embodiment of the invention;

DESCRIPTION OF THE PREFERRED EMBODIMENTS

Figure 1:
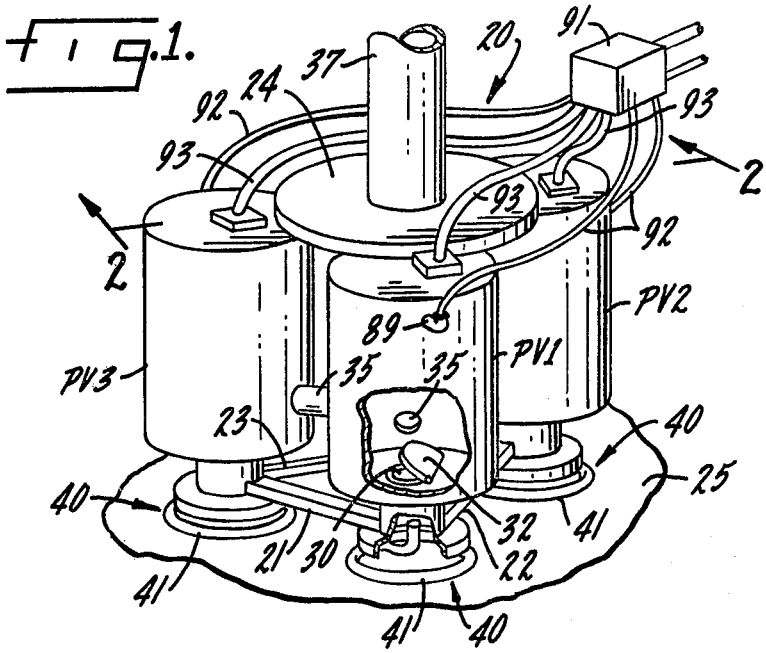
FIG. 1 is a perspective view, partly cut away, of a dredging head employed in one embodiment of the invention.
Figure 2:
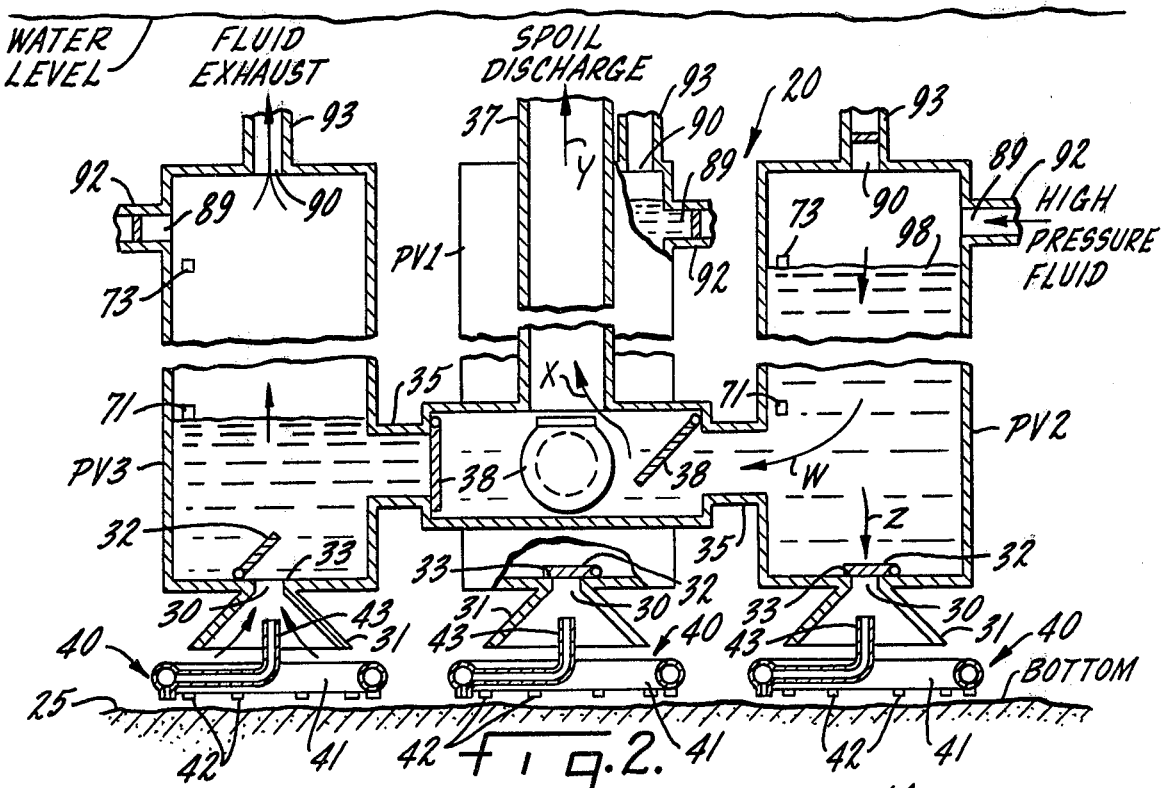
FIG. 2 is a developed sectional elevation view, partly schematic, of the dredging head, taken generally as indicated by line 2—2 in FIG. 1.

FIGS. 1 and 2 illustrate a dredging head 20 which comprises three pressure vessels PV1, PV2, and PV3 incorporated in a unitary structure. As shown in FIG. 1, pressure vessels PV1, PV2 and PV3 may be joined together by three struts 21-23 which are welded, bolted, or otherwise affixed to the bottom portions of the pressure vessels. The tops of the pressure vessels are welded or otherwise joined to a common structure 24. Thus, vessels PV1, PV2, PV3 form a single rigid head 20 which may be lowered as a unit into a body of water such as a pond, lake, bay or stream; head 20 may be suspended on or near the bottom to dredge material from the bottom of the body of water, or can be suspended at an intermediate level to pump water. Usually, dredging head 20 is suspended just above the bottom.

Pressure vessel PV1 is shown partially broken away in FIG. 1 to illustrate a simple material intake check valve 32 in an intake port 30 located in the bottom of the vessel. Similar intake ports with check valves are provided in vessels PV2 and PV3, as shown in FIG. 2.

Each of the pressure vessels PV1, PV2 and PV3 is a simple closed chamber having a large material intake port 30 in the bottom of the vessel (FIG. 2). Port 30, in each vessel, connects the interior of the vessel with the interior of an intake nozzle deflector shield 31. A check valve 32 is located over the intake port 30 in each vessel; valve 32 moves between open and closed positions in response to changes in differential pressures acting on the opposite sides of the valve. When valve 32 is open, as shown for vessel PV1 in FIG. 1 and vessel PV3 in FIG. 2, water, silt, mud and other material enters opening 30 and fills the pressure vessel. When valve 32 for any vessel closes upon its valve seat 33 (FIG. 2), material inside the pressure vessel cannot pass back out through its intake port 30.

A series of individual spoil pipes 35 afford material outlet ports that connect the individual pressure vessels PV1, PV2 and PV3 to a common discharge conduit constituting a main spoil pipe 37 (FIGS. 1, 2). Individual check valves 38 are located in the material outlet ports 35 (FIG. 2). Check valves 38 each move between open and closed positions in response to differential pressures acting upon the opposite sides of the valve.

Dredging head 20 (FIGS. 1, 2) incorporates jet blast means for stirring up and loosening bottom material under the dredging head and for increasing the filling velocity of the pressure vessels PV1-PV3. Thus, a jet blast device 40 is mounted adjacent the bottom edge of each deflector nozzle 31 (FIG. 2) and is employed to stir up and loosen the mud, soil, sand, and other debris on the bottom 25 under the nozzle. Each device 40 also provides a Venturi assist jet to accelerate filling of the pressure vessel with which it is associated.

The jet blast devices 40 may be removably mounted on dredging head 20 because the presence of pollution materials on the bottom may make it desirable to avoid their use. Some bodies of water are fairly clean and there is no pollution problem presented when the bottom is stirred up. Others are quite polluted, so that if the bottom is agitated excessively the pollutants become suspended in the water and re-settle following dredging. If this happens, little or no benefit is gained by the dredging operation. In these circumstances, it is preferable to remove the upper (pollutant) layer from the bottom without the agitation provided by the jet blast devices 40. When there is a heavy cover of vegetable matter on the bottom, it may be necessary to cut away the vegetable matter first to enable the dredging head to dig out the bottom surface.

Each jet blast device 40 comprises a circular pipe 41 attached to a pressurized fluid supply line and having a plurality of nozzles 42 directed downwardly from the pipe. Nozzles 42 are aimed to stir up and loosen the bottom surface 25 under the deflector 31. The desired pattern of the jet blast from nozzles 42 may vary somewhat, depending upon the nature of the bottom surface 25. Thus, the orientation of nozzles 42 may be directed one way for sand, another for mud, and still another for a surface covered with stones or the like.

A fill jet assist nozzle 43 is connected to pipe 41 in each jet blast device 40, extending from pipe 41 upwardly toward intake port 30. High pressure fluid directed through nozzle 43 produces a Venturi effect to reduce the pressure in port 30 and materially increase the flow of water into the pressure vessel when that vessel is being filled. Thus, each jet blast unit 40 serves the dual functions of stirring up and loosening the bottom surface 25 under the pressure vessel with which it is associated and creating a Venturi effect to increase the intake velocity of material flowing into the vessel. The particular fluid used to power the jet blast devices 40 depends to some extent upon the dredging needs and capability of a particular unit. The fluid used may be high pressure air or it may be high pressure water.

Either of these fluids may be partly re-used when one of the pressure vessels is being emptied. Thus, at one point in its operating cycle each pressure vessel is full of fluid, under high pressure, which must be exhausted so that material may be drawn in through the intake port 30 to fill the vessel. At least some of the pressurized fluid from that vessel may be directed through its jet blast device 40 during the filling process. The decision on whether to use air or water in the jet blast devices 40 depends on the jet force required for the bottom surface. Water, being heavier, is the preferred medium when major force is required to dislodge the bottom surface material sufficiently to permit effective dredging.

Figure 3:
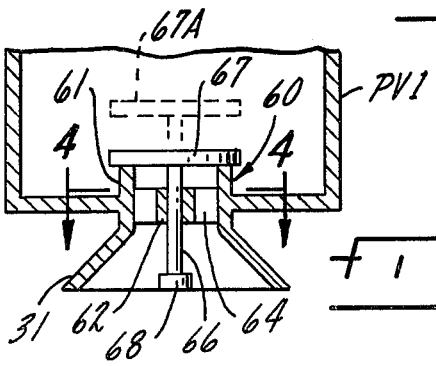
FIGS. 3 and 4 are detail sectional views of an alternate form of material intake check valve for the pressure vessels in the dredging head of FIGS. 1 and 2.
Figure 4:
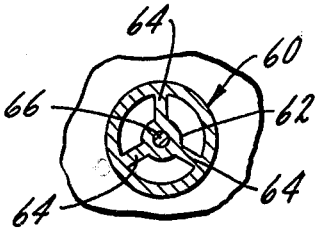

FIGS. 3 and 4 illustrate an alternative construction for use in place of the flapper-type check valves 32 and 38 shown in FIGS. 1 and 2. The construction shown in these figures is directly applicable to the intake port check valves, but can also be applied to the outlet ports. Thus, the valve shown in FIG. 3 comprises a conduit 60 extending upwardly from deflector 31 into the bottom of a pressure vessel such as vessel PV1. The upper portion 61 of pipe 60 extends above the inside bottom surface of the pressure vessel. A vertical cylindrical sleeve bearing 62 is located in the center of intake port 30. Sleeve bearing 62 is supported by a plurality of support elements 64 which hold it rigidly in position while allowing sufficient room in port 30 for material, even when heavily laden with debris, to enter the pressure vessel.

A valve stem 66 is slidably mounted in sleeve 62. A valve plate 67 is affixed to the top of stem 66 and a large nut or other stop member 68 is mounted on the bottom end of the stem. The valve is shown in its closed position in FIG. 3, the position occupied by the valve when pressure inside the vessel is greater than outside. When the pressure differential is reversed and the outside pressure exceeds the internal pressure, the valve member 66–68 slides upwardly in sleeve 62 until stop member 68 engages sleeve 62 to preclude further upward movement. This open condition for the valve, indicated by the dash line position 67A for plate 67 in FIG. 3, allows water, mud, silt, and other such material to enter the pressure vessel over the top of pipe 60, in the space between the pipe and valve plate 67.

A variety of different check valves can be used with the pressure vessels PV1-PV3. To some extent the particular style of valve employed depends upon the nature of the material being pumped. For general use, the embodiment of FIGS. 3 and 4 is preferred.

Referring back to FIG. 2, it is seen that each of the pressure vessels PV1-PV3 includes a lower level sensing device 71 and an upper level sensor 73. Sensors 71 and 73 may comprise electrical sensing devices which complete or interrupt an electrical circuit in response to the presence of conductive material within the pressure vessel. On the other hand, float valves and other sensors, some described hereinafter, can be employed.

Each of the pressure vessels PV1-PV3 has an upper inlet port 89 for supplying an operating fluid (air) under pressure to the interior of the vessel. The upper portion of each vessel also includes an exhaust port 90 utilized to drain the operating fluid from the vessel. The three exhaust ports 90 are connected to a control unit 91 (FIG. 1) by suitable conduits 93. In the same manner, all of the inlet ports 89 for the three pressure vessels are connected to control unit 91 by individual hoses or other suitable conduits 92.

The basic operating cycle for dredging head 20 can be described with reference to FIG. 2. At the start of operations, the dredging head is lowered into a lake, pond, stream, bay, or other body to be dredged. For effective dredging, head 20 is located on or immediately above the bottom 25.

While dredging head 20 is lowered into position, all of the operating fluid inlet and exhaust conduits 92 and 93 are maintained open, through control unit 91 (FIG. 1), so that the interior of each pressure vessel is at atmospheric pressure. With the increase in external hydrostatic pressure caused by immersion of dredging head 20, the check valves 32 open and each of the pressure vessels fills with water. Dredging head 20 comes to rest in its operating position near the bottom. The pressures equalize in vessels PV1–PV3 and the check valves 32 close. Gravity may be sufficient to close the check valves, or a moderate spring bias tending to close the valves may be employed.

To begin dredging operations, high pressure air or other operating fluid is supplied to one of the vessels PV1-PV3 through its inlet conduit 92 and port 89, with the exhaust port 90 and exhaust line 93 for that vessel closed. In FIG. 2, it is assumed that this condition has been established for pressure vessel PV2. At this time, the exhaust ports 90 and lines 93 for vessels PV1 and PV3 are open and the inlet ports 89 and conduits 92 for those vessels are closed. The increase in pressure in vessel PV2 opens its check valve 38 and forces water and other material out of the vessel through its outlet port 35 and up through spoil pipe 37, as indicated by arrows W, X and Y. In addition, the increased pressure in vessel PV2 acts to hold check valve 32 closed as indicated by arrow Z. The increased pressure in spoil line 37 tends to hold the outlet port check valves 38 of the other pressure vessels PV1 and PV3 closed.

Ultimately, the water level in vessel PV2 falls below the lower level sensor 71 in that vessel. The low level sensor 71 is connected to control unit 91 (FIG. 1) and actuates the control unit to shut off the supply of high pressure air or other operating fluid to vessel PV2 that has previously been maintained through its input line 92 and input port 89. At the same time, the control unit opens a quick dump valve in the line 93 from exhaust port 90 of vessel PV2, venting that vessel to the atmosphere. As a consequence, the pressure within vessel PV2 begins to reduce, its outlet port check valve 38 closes, and its intake port check valve 32 opens to begin filling vessel PV2 with a new supply of material from the bottom of the body of water being dredged.

When the changeover for vessel PV2 from its discharge to its filling phase occurs, one of the other two vessels PV1 and PV3 is also changed, entering its discharge cycle. That is, assuming that the next vessel in the sequence is vessel PV3, high pressure air is now introduced into that vessel through its inlet port 89 and conduit 92, with its outlet port 90 and conduit 93 closed. To preclude surging, the changeover to discharge for vessel PV3 should occur simultaneously with or slightly prior to initiation of the filling cycle in vessel PV2. In this manner, a continuing smooth flow of water and entrained mud and other debris is maintained out through spoil pipe 37. Vessel PV1 remains full until vessel PV3 is emptied. At that time, vessel PV3 is switched to its filling phase and vessel PV1 begins to discharge.

The use of at least three pressure vessels is required, under the present invention, so that at least one pressure vessel is always full and ready to begin discharge. This allows substantial latitude with respect to the relative rates of filling and emptying, including a situation in which filling of each pressure vessel requires considerably more time than emptying. With this arrangement, surging is eliminated, even though the dredge may be used under varying depth conditions, with no requirement for modification of the dredge controls. For a dredge that is likely to be used in pumping extremely heavy materials under relatively limited hydrostatic head conditions, it may be desirable to add a fourth pressure vessel. In any circumstances, the control of the present invention provides that one vessel is always being discharged, another is filling, and one vessel is always full and ready for discharge when the vessel currently discharging reaches its empty condition.

Figure 5:
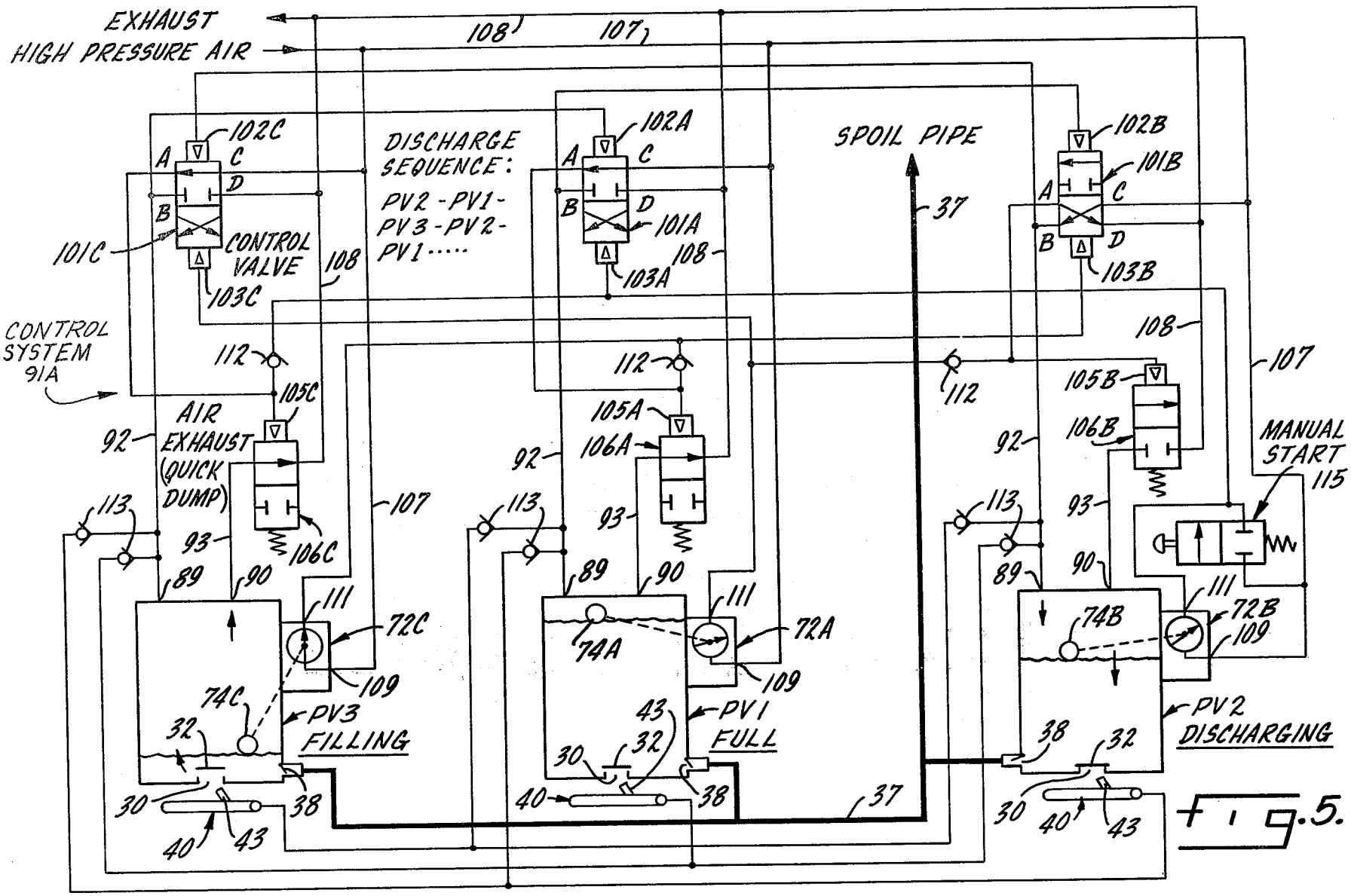
FIG. 5 is a schematic diagram of a pneumatic control system for one embodiment of the invention.

FIG. 5 illustrates, in schematic form, a pneumatically operated dredging system control 91A constructed in accordance with one embodiment of the present invention. System 91A controls three pressure vessels PV1-PV3 which may be assumed to have the construction illustrated in FIGS. 1 and 2 and described above except that the upper and lower level sensors 71 and 73 (FIG. 2) are not employed. Instead, each of the pressure vessels controlled by system 91A (FIG. 5) is equipped with a rotary float valve 72A-72C actuated by a float 74A-74C.

Control 91A comprises three main control valves 101A–101C, one for each vessel PV1-PV3; each valve 101 has two pneumatically actuated pilots 102 and 103. The valves 101 do not have a normal or "home" position. If the pressure supplied to pilot 102 exceeds that for pilot 103, the valve takes the position shown for valves 101A and 101C for vessels PV1 and PV3; for reversed pressure conditions, the valve moves to an alternate position as illustrated by valve 101B for vessel PV2. Each valve 101 has two outlet ports A and B and two inlet ports C and D. Each outlet port A is connected to the pilot 105A–105C of an associated quick-dump exhaust control valve 106A–106C. Port B of each valve 101 is connected to the air inlet port 89 of its pressure vessel through the connecting line 92 for that vessel. Inlet port C of each valve 101 is connected to a high pressure air supply line 107; the high pressure air supply (not shown) may comprise a conventional compressor. Inlet port D of valve 101 is connected to a common exhaust line 108.

Each exhaust valve 106 is interposed between the exhaust line 93 from port 90 of its pressure vessel and the main exhaust line 108. Valve 106 is a pneumatically actuated valve having a spring return. For vessels PV1 and PV3, valves 106A and 106C are each shown actuated to "fill" position, each connecting the pressure vessel exhaust port 90 to exhaust line 108. Valve 106B is shown in its "discharge" position, in which it effectively closes exhaust port 90 of vessel PV2.

The float valves 72A and 72B for vessels PV1 and PV2 in control system 91A (FIG. 5) are shown in closed condition. Each float valve 72 is utilized only to sense the emptying of its pressure vessel below a given level and is maintained closed, as shown for vessels PV1 and PV3, at all other times. Each float valve 72 has an inlet port 109 connected to the high pressure air line 107 and an outlet port 111 connected to the pilot 103 of the main control valve 101 of one adjacent pressure vessel. Thus, the outlet port 111 of the float valve 72A for vessel PV1 is connected to the pilot 103C of the main control valve 101C for vessel PV3, the outlet port 111 for the float valve 72B of vessel PV2 is connected to the pilot 103A of the main control valve 101A for vessel PV1, and the outlet port 111 for the float valve 72C of vessel PV3 connects to the pilot 103B of the control valve for vessel PV2. The outlet port 111 of each float valve 72 is also connected, through a check valve 112, to the pilot 105 of the exhaust valve 106 for the other adjacent pressure vessel.

The control valve 101A associated with vessel PV1, in system 91A, has its outlet port B connected to the pilot 102B of the control valve 101B for vessel PV2. Similarly, port B of the main control valve 101B for vessel PV2 is connected to the pilot 102C of the valve 101C for vessel PV3, whereas port B of the valve 101C for vessel PV3 is connected to the pilot 102A for the valve 101A associated with vessel PV1.

Outlet port B of control valve 101A for vessel PV1 is connected, through two check valves 113, to the jet blast devices 40 of vessels PV3 and PV2. In the same manner, the B port of the control valve 101B for vessel PV2 is connected to the jet blast devices 40 for vessels PV2 and PV3, whereas port B of the control valve 101C for vessel PV3 is connected to the jet blast devices 40 for vessels PV1 and PV2.

System 91A (FIG. 5) further comprises a two-position manually actuated sequence start valve 115, connected in parallel with the float valve 72B for vessel PV2. Valve 115 is normally closed, as shown, but can be actuated manually to initiate a flow of high pressure air to pilot 103A of valve 101A.

In considering the operation of control system 91A, FIG. 5, it may be assumed that the system starts in the illustrated condition with the main control valves 101A and 101C in their "fill" positions, valve 101B in its "discharge" position, exhaust valves 106A and 106C open, exhaust valve 106B closed, float valves 72A and 72B closed, and float valve 72C open. For this first phase of the control cycle, pressure vessel PV1 is standing full, pressure vessel PV2 is discharging, and pressure vessel PV3 is filling.

In the first phase in the operating cycle of control 91A, high pressure air is supplied to the jet blast devices 40 associated with vessels PV1 and PV3; the air connection extends from the high pressure line 107 through ports C and B of valve 101B and through the two check valves 113 which connect the air inlet line 92 of vessel PV2 to those jet blast devices. The air from the jet blast devices 40 for vessels PV1 and PV3 stirs up and loosens the surface material and debris under those two vessels. The check valve 32 of vessel PV3 is open; accordingly, a portion of the high pressure air flows upwardly from the filling assist nozzle 43 of the device 40 below vessel PV3 and through its intake port 30, creating a Venturi effect. The high pressure operating fluid also tends to clean out any debris lodged in the seat of the check valve 32 for vessel PV1. If that valve is completely closed, or when it closes, the high pressure air flowing through the jet assist nozzle 43 beneath vessel PV1 merely escapes from the associated deflector 31 (see FIG. 2) to create additional turbulence that contributes to the dispersion of debris loosened by the jet blaster.

The first change occurring in system 91A, from the conditions described above and shown in FIG. 5, is actuation of float valve 72C from the illustrated open condition to closed condition as vessel PV3 begins to fill and float 74C rises within the vessel. This action occurs shortly after vessel PV3 begins to fill; float valve 72C is open only for a relatively brief interval when the water and suspended material within vessel PV3 is at its lowest level. When valve 72C closes, the previous high pressure air supply to pilot 103B of control valve 101B that had been maintained through valve 72C is cut off. However, the operating condition of control valve 101B does not change because the air trapped in the line to pilot 103B is still at a pressure higher than that for pilot 102B, pilot 102B being essentially at atmospheric pressure due to its connection to the top of vessel PV1, which is presently vented to the atmosphere.

The next operating change in control system 91A is the opening of float valve 72B, which occurs when float 74B reaches a predetermined position near the bottom of pressure vessel PV2. Opening of valve 72B establishes a high pressure air connection from line 107 through valve 72B to pilot 103A of control valve 101A. As a consequence, valve 101A is driven to its "discharge" position, the position illustrated for valve 101B in FIG. 5. This establishes a connection for high pressure air from line 107 through ports C and B of valve 101A and through inlet line 92 to the air inlet port 89 of pressure vessel PV1. In addition, the previously prevailing high pressure air connection through valve 101A to pilot 105A of exhaust valve 106A is cut off and valve 106A reverts to its normal closed condition. This completes a changeover for vessel PV1 from the illustrated filling condition to a discharge of emptying condition. High pressure air entering vessel PV1 through its inlet port 89 forces water and entrained material out through check valve 38 and up spoil pipe 37 to maintain a continuous flow of dredged material out the spoil pipe. The increased pressure in vessel PV1 assures complete closing of its intake check valve 32.

With control valve 101A now in its "discharge" condition, a high pressure air connection is also established from port B of that valve to pilot 102B of control valve 101B. This drives control valve 101B to its lower "fill" position, since the high pressure air supply to pilot 103B has previously been cut off as described above.

With control valve 101B now in its "fill" condition, the previously prevailing high pressure air supply from line 107 through ports C and B of that valve is no longer available. Thus, input of high pressure air to vessel PV2 is cut off. The pressure in spoil pipe 37 now exceeds the pressure in vessel PV2, so that check valve 38 closes and the flow of water and entrained material from vessel PV2 is interrupted. This discharge through spoil pipe 37 continues, but from this point the supply comes only from vessel PV1.

The changeover of control valve 101B to its "fill" position also establishes a high pressure air connection from its port A to pilot 105B. As a consequence, air exhaust valve 106B shifts downwardly to its open position, venting vessel PV2 to the atmosphere through its exhaust port 90, exhaust conduit 93, valve 106B, and exhaust line 108. This establishes vessel PV2 in the condition illustrated for vessel PV3 in FIG. 5, starting its fill cycle. This completes the changeover of control 91A to its second phase of operation; vessel PV1 is now discharging and vessel PV2 is filling. Vessel PV3 may already be full or may be completing its filling operation.

With the second phase conditions now established for control 91A, FIG. 5, it should be noted that the jet blast devices 40 beneath vessels PV3 and PV2 are supplied with high pressure air through valve 101A, whereas the previously prevailing high pressure air supply to the jet blast device 40 below vessel PV1 has been cut off.

System 91A is conditioned for the next cycle changeover when the level of water and entrained debris and other material in vessel PV2, which is now filling, attains a level sufficient to close float valve 72B. This cuts off the high pressure air supply to pilot 103A. However, the operating condition for valve 101A does not change because the pressure at pilot 103A still exceeds that of pilot 102A.

The changeover to the third phase of operation of control system 91A is initiated when the float valve 72A for vessel PV1, which has been discharging, opens. This establishes a high pressure air connection from line 107 through valve 72A to pilot 103C of valve 101C. Accordingly, valve 101C is actuated to its "discharge" position, since the high pressure connection to its pilot 102C has previously been cut off. The actuation of valve 101C to its discharge condition establishes a high pressure air flow into vessel PV3 through its inlet conduit 92 and inlet port 89. The high pressure air supply to pilot 105C of exhaust valve 106C is cut off, and that valve reverts to its closed condition, shutting off the exhaust port 90 of vessel PV3. The consequent build-up of pressure in vessel PV3 forces check valve 32 fully closed and opens check valve 38 to establish a flow of water and entrained dredged material out through check valve 38 of vessel PV3 and through spoil pipe 37. The changeover of valve 101C to its discharge condition also establishes a high pressure air supply to pilot 102A to actuate valve 101A to its "fill" condition.

With valve 101A now in its fill condition, the previously prevailing high pressure air supply to the inlet port 89 of vessel PV1 is cut off. High pressure air is supplied to pilot 105A, opening valve 106A to vent vessel PV1. Vessel PV1 starts to fill and the changeover to the third phase of the system cycle is complete. Of course, the previously described change in the operating condition for valves 101C and 101A results in switching of the air supply to the jet blast devices 40 so that now the jet blast is effective below vessels PV1 and PV2 and is shut off below vessel PV3. Vessel PV1 is now filling, vessel PV3 is discharging, and vessel PV2 is full or may be completing its filling operation.

Control system 91A next reverts to its first phase of operation, as illustrated in FIG. 5. The changeover is pre-conditioned by the closing of float valve 72A and initiated upon the opening of float valve 72C. Because the change occurs in the same manner as described above, a detailed description is deemed unnecessary.

For control system 91A, the positions of the air exhaust valves 106A-106C can be relatively critical. If these valves are located only a short distance above pressure vessels PV1-PV3, water, mud, and debris may be forced into the valves, with consequent substantial deterioration in operation which may force a shutdown and cleanout of the system. Thus, for system 91A it is important to locate valves 106A–106C as high above the pressure vessels as practically possible.

When the dredging head comprising vessels PV1-PV3 is lowered into the body of water to be dredged, the high pressure air line 107 is left vented to the atmosphere so that all three pressure vessels fill with water. To start dredging operations, line 107 is connected to a compressor and the manual start switch 115 is opened by the dredge operator to stimulate completion of a discharge cycle for vessel PV2. The starting condition thus begins with discharge from vessel PV1, followed by vessels PV3 and PV2 in the sequence described above. Of course, the manual start valve can be connected to any of the pressure vessels as desired.

Control system 91A, FIG. 5, has been described as if all of the high pressure air for dredging passes through valves 101A-101C, which is easier to understand. However, in actuality this would be an expensive procedure since large-volume rapid-acting slide valves are relatively expensive. More efficiency and lower cost may be realized if the pressure line 107 is connected to each pressure vessel through an appropriate relay valve (not shown). A relay valve may be operated by a relatively small amount of high pressure air to open a very large orifice valve and thereby couple a large diameter hose to each pressure vessel and to the appropriate jet blasters. Likewise, relay valves may be used when pressurized water is used instead of air in the jet blasters 40. The principle of operation is exactly the same as described in connection with FIG. 5 except that faster pumping is realized at lower cost.

In control 91A, the sensor valves 72A–72C are shown as mechanically operated valves, actuated directly by their associated floats 74A–74C. It will be recognized, however, that electrical sensors connected to electrically actuated valves can be employed with no change in the overall operation of the system.

Figure 6:
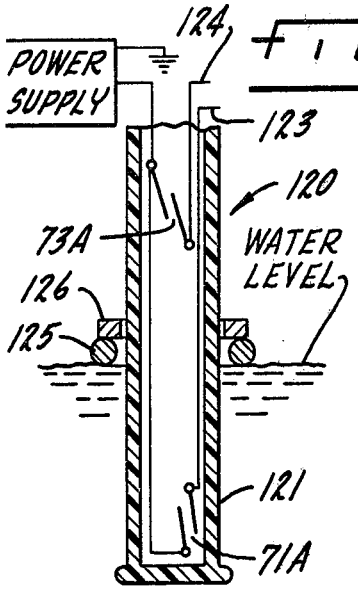
FIG. 6 is a sectional elevation view, partly schematic, of one form of level sensor apparatus which may be used in the systems of the invention.

FIG. 6 illustrates a level sensor assembly 120 that may be used in the dredging control systems of the present invention. Sensor assembly 120 includes a closed tube 121 of non-magnetic material with a first magnetically-actuated reed switch 71A mounted in the bottom portion of the tube and a second reed switch 73A mounted in the upper part of the tube. Each of the two reed switches has one pole connected to a power supply 122; the other poles of the switches 71A and 73A are connected to two signal conductors 123 and 124, respectively. Surrounding tube 121 is a toroidal float 125; a magnet 126 is mounted on the float. Tube 121 extends downwardly into one of the pressure vessels of the dredge.

As the water level raises and lowers in the pressure vessel, magnet 126 floats up and down accordingly. Whenever float 125 raises magnet 126 into alignment with reed switch 73A that switch closes to signal, on line 124, that the water has reached an upper threshold level. Whenever float 125 and magnet 126 sink into alignment with sensor switch 71A, that switch closes to signal, on line 123, that the water has been reduced to a lower threshold level. The lower threshold level signal can be employed to initiate a fill phase, the upper level signal to interrupt a fill phase as described hereinafter. Of course, the lower level sensor 71A can be used, independently of the presence of any upper level sensor, in a suitable control such as system 91A (FIG. 5).

The water level sensor assembly 120, FIG. 6, provides accurate level signals. However, if the dredging head is used in very deep water, the pressure may become high enough to impose excessive loading on tube 121 or may compact float 125 so that it ceases to function reliably.

Figure 7:
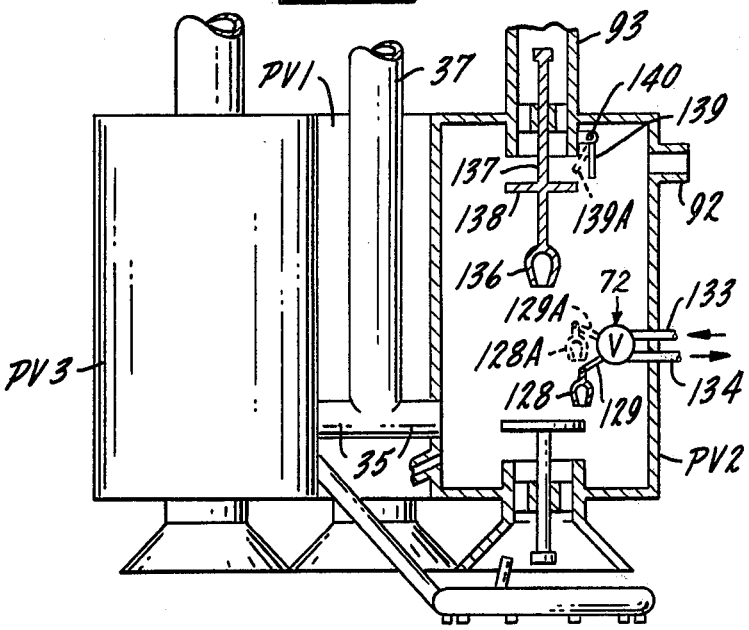
FIG. 7 is a partially sectional, partly schematic elevation view of a hydraulic dredging head constructed in accordance with another embodiment of the invention.

A level sensing assembly more suitable for deep water use is shown in FIG. 7. The float is a thin shell housing 128 having a closed top and open bottom. Float 128 hangs freely from a pivot point 130 at the end of a lever arm 129. The shell float 128 is constrained so that it cannot invert itself. Therefore, when the pressure vessel PV2 empties, float 128 fills with air. When water enters the pressure vessel, air is entrapped within the top of float 128. Consequently, as water rises in vessel PV2, the shell floats upwardly. This raises lever arm 129 to the position shown by dotted lines 129A. As the water continues to rise, float 128 merely submerges and remains in position 128A. The air entrapped inside is compressed within the shell float. The shell of float 128 does not have to withstand any substantial pressure gradient since the same pressure appears on both the inside and outside surfaces of the shell.

Float 128 may operate any suitable valve or other device 72 to signal changes in the water level which moves the float. As here shown, valve 72 opens and closes a pneumatic line comprising pipes 133 and 134. Thus, the construction shown in FIG. 7 is directly applicable to the float sensor valves 72A–72C in control system 91A (FIG. 5). On the other hand, sensor 72 may be an electrical switch, in which case lines 133 and 134 are replaced by appropriate wiring. Other signal transmission media may also be employed, depending on the sensor utilized.

The same kind of open-bottom, hollow-shell float mechanism may also be used as an exhaust line check valve for the pressure vessel. Thus, an open bottom hollow shell 136 may be attached to the bottom of a sliding valve stem 137 which supports a circular valve closure disc 138. Thus, the air intake valve disc 138 drops under gravity when pressure vessel PV2 empties. Float 136 raises disc 138 to shut the valve by seating disc 138 against the lower rim of air exhaust-conduit 93 when pressure tank PV2 fills.

Means are provided to prevent the valve 136–138 from closing prematurely. When the valve first opens after vessel PV2 has been fully pressurized to initiate its discharge phase, there is a rush of air up the exhaust line 93 which tends to blow the valve shut. A blade or rod 139 is pivoted at 140 to swing in front of valve disc 138. Any draft of air sufficient to blow the valve shut is also strong enough to blow blade 139 to a position 139A in which it holds the valve open. When the water level in vessel PV2 raises float 136, the valve moves to a closed position, disc 138 passing blade 139 without interference.

Figure 8:
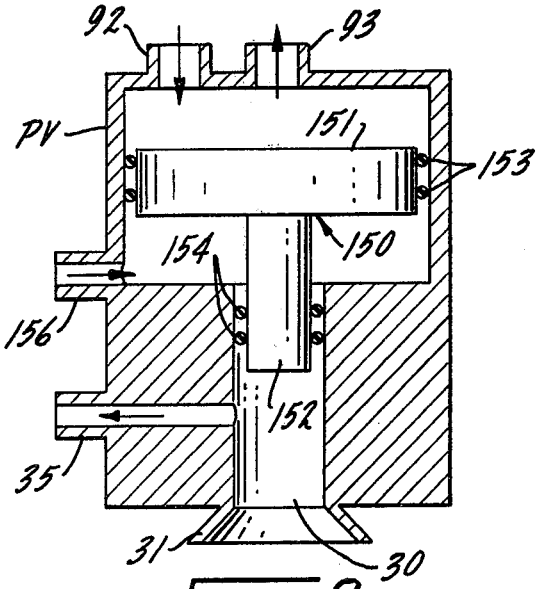
FIGS. 8 and 9 are schematic sectional elevation views of two forms of differential pistons for increasing commercial compressor pressure to much higher pumping pressures for use in some embodiments of the invention.

The sources of pressurized air are not shown in the drawings. However, it is contemplated that standard commercial compressors will be used. When higher pressures are required, a differential piston arrangement may be used. FIG. 8 shows one embodiment of such a differential arrangement, comprising a piston 150 having a large end 151 and a small end 152. If the area of the large end 151 is, for example, fifteen times greater than the area of the small end 152, the pressure is multiplied by fifteen. Thus, if air is delivered to the space in the pressure vessel PV above the large end 151 at a standard commercial compressor pressure of one hundred pounds per square inch, the pressure delivered at the small end is 1500 psi.

In effect, the large-small chambers at opposite sides of the piston trade time for a pressure head. It will take a longer period of time for the large chamber above piston 150 to fill with pressurized air; therefore, the piston movement in the small chamber below the piston is slow and relatively small, but the pressure per square inch is greater. The converse is true when the pressurized air is delivered to the small chamber. A much greater pressure per square inch is required to move the large volume, at a low pressure, from the large chamber side. The high pressure on the small chamber side is sufficient to pump wet cement or to jet pilings from a barge when presently available, standard commercial compressors are used.

FIG. 8 shows the use of the differential piston 150 within a pressure vessel PV. The pressurized air is pumped into the space in pressure vessel PV above the large end 151 of piston 150. The dredged water enters the pressure vessel PV, through deflector 31 and intake port 30, under the small end 102*a* of the piston. Therefore, the augmented dredging pressure is produced by the differential piston acting directly upon the dredged water or pumped material. The advantage of this arrangement is that a relatively low-pressure air line 93 may be used to carry the pressurized air from the surface to the vessel. The one disadvantage is that pumping is slow and the piston seals, such as the O-rings 153 and 154, absorb water from abrasive material which is dredged with the water.

Figure 9:
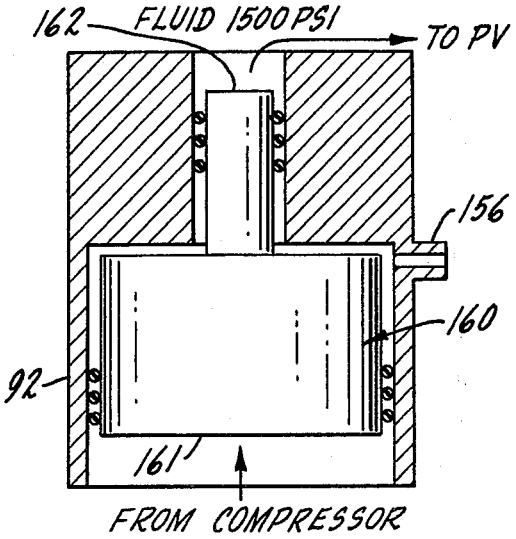

FIG. 9 shows an embodiment in which a differential piston 160 is connected in the inlet air line 92. The compressor is connected to the large face 161 of the piston. The pressure vessel PV is connected to the 1500 psi side at the small face 162. Therefore, the air pumped into the pressure vessel is compressed to much higher pressures by the differential piston. Here, the advantage is that the piston O-rings are not subjected to the same degree of abrasion by the dredged grit. The disadvantage is that a part of the air line 92 must withstand higher pressures, but pumping may be much faster.

In the arrangements of either FIGS. 8 or 9, it may be necessary to relieve back pressure behind the differential piston. This can be accomplished by reusing the high pressure air as it is released from inside the pressure vessel. Thus, after a pressure vessel has been pumped full of air to drive the water out and up the spoil line, the air inlet control valve closes and the quick dump exhaust line 93 is opened. If the exhaust line 93 of a fully-pressurized vessel is connected to an inlet 156 behind the differential piston, there will be a force tending to shift the piston as long as the pressurized vessel is exhausting.

Figure 10:
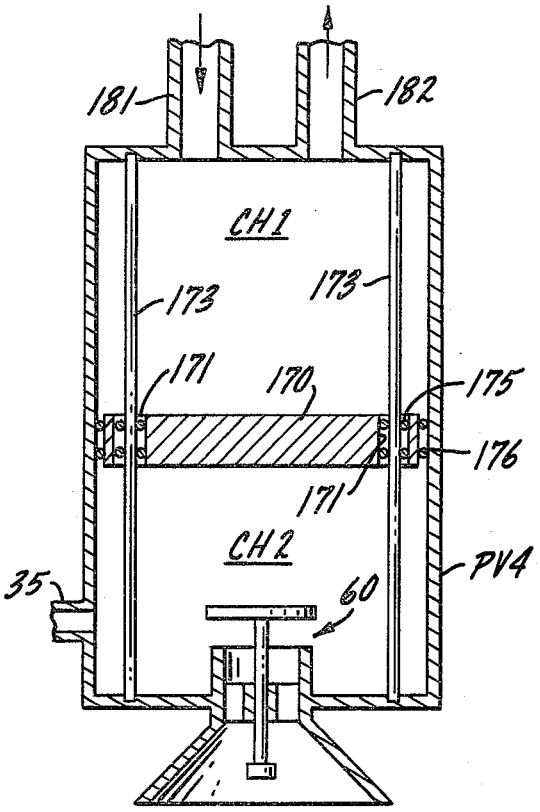
FIGS. 10 and 11 are schematic sectional elevation views of pressure vessels for hydraulically powered dredging systems.
Figure 11:
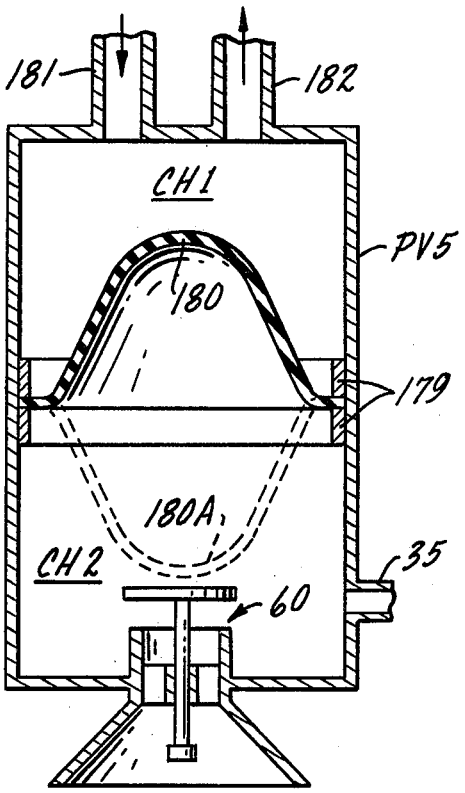

FIGS. 10 and 11 illustrate pressure vessel constructions particularly suitable for use in deep water where very high pressures are encountered. The pressure vessels PV4 and PV5 are both operated hydraulically rather than pneumatically. Each contains two chambers CH1 and CH2 separated by a movable bulkhead to separate the dredged water from the hydraulic operating fluid.

Pressure vessel PV4, FIG. 10, includes a sliding piston 170 having a plurality of openings 171 for receiving guide rods 173 which confine the piston travel so that it moves axially of the pressure vessel. Suitable O-rings 175 and 176 seal the piston to the inner sides of pressure vessel PV4 and to the guide rods 173 so that the hydraulic fluid and dredged material do not become mixed.

In FIG. 11 a suitable clamp structure 179 secures an unbroken flexible diaphragm 180 around the inside periphery of the pressure vessel PV5. When hydraulic fluid is exhausted from chamber CH1 of pressure vessel PV5, diaphragm 180 stretches upwardly, as shown by solid lines. When hydraulic fluid is pumped into the vessel, diaphragm 180 is deflected downwardly to the position shown by dashed lines 180A.

In each of the vessels PV4 and PV5, hydraulic fluid is pumped into chamber CH1 through a pipeline 181. As the chamber CH1 fills with hydraulic fluid, piston 170 or diaphragm 180 is forced downwardly to reduce the volume of chamber CH2. This closes check valve 60 and drives the water from chamber CH2 out through discharge line 35 and up the spoil pipe. Thereafter, in either vessel PV4 or PV5, a hydraulic fluid discharge pipe 182 is opened to relieve the pressure in chamber CH1. The external water pressure opens check valve 60 and causes water, with entrained debris, to enter chamber CH2. In deep water dredges employing hydraulically operated pressure vessels, like vessels PV4 and PV5, it may be more convenient and efficient to meter the flow of hydraulic fluid than to attempt to sense the position of the piston 17 or diaphragm 180. Accordingly, the dredging control system on the surface may be constructed to pump a predetermined volume of hydraulic fluid down line 181 and then allow the same amount of fluid to flow up line 182 in the discharge and fill cycles of the pressure vessel.

Figure 12:
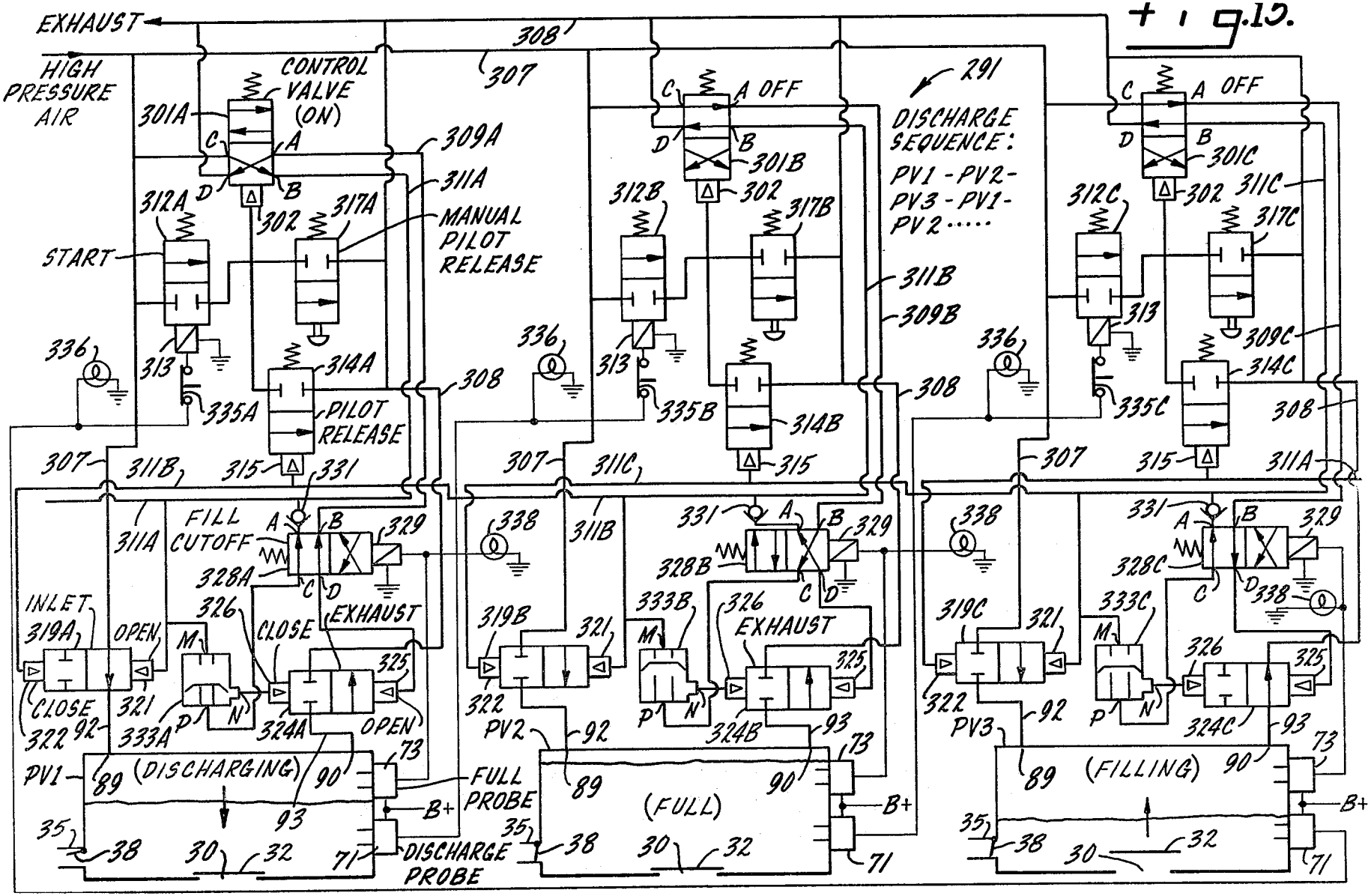
FIG. 12 is an exploded perspective view, partly cut away, of a preferred form of dredging head for use in the dredging systems of the invention.

A preferred construction 200 for the dredging head is shown in FIG. 12. Dredging head 200 comprises an essentially rectangular housing 202, although any suitable shape will do equally well. Inside housing 202 there are a plurality of partitions 204, 206, 208 and 210 which divide the housing into four watertight chambers, three aligned parallel to each other and the fourth chamber 237 spanning the first three at the rear of the housing. Each of the three front chambers includes a port, ports 212, 214 and 216, for communicating with one of three pressure vessels PV11, PV12 and PV13 sealed to the port.

Three intake check valves 232, shown as flapper valves, are located in the bulkheads or walls of housing 202 around an intake region 220. The common read chamber 237, which is a spoil line connection chamber, is connected to each of the three front chambers by three spoil line flap valves 238 (only one shown) mounted in the bulkhead 208 that is common to all four chambers in housing 202.

The intake region 220 is an alcove formed in the front of housing 202, which is open in a forward direction A1 and downward direction B1. The intake check valves 232 are formed in the bulkheads which make up this alcove. An important reason for providing such an alcove is that it enables the dredge to be tailored to the conditions, especially the pollutants, at the bottom of a lake.

In the three examples described hereinafter: (1) the bottom is a dense muck which must be removed in limited quantities, virtually a shovelful at a time, with almost no diffusion of pollutants into the water; (2) the bottom is covered with vegetation which must be cleared before dredging can occur; and (3) the bottom is a material which should be lifted straight up, with only a little diffusion of bottom material into upper water.

The bottom removal is controlled by a pump 222 attached to housing 202 over a port 224 above the intake alcove 220. Pump 222 preferably comprises a hydraulically-driven motor having an impeller 228 mounted on its shaft. If desired, a rotary blade 230 may also be mounted on the motor shaft at a suitable elevation below impeller 228. Blade 230 is similar to the blade of a rotary lawn mower. Rotation of the pump impeller 228 draws ambient water and other material into alcove 220, from which it is discharged through check valves 232 into the chambers of housing 202 and into the associated pressure vessels PV11-PV13 via the ports 212, 214 and 216. When the blade 230 is used, it mows vegetation on the bottom of the lake.

If the bottom is free of serious problems such as heavy pollutants or vegetation, dredging head 200 may be used in the form described thus far. Any churning of the bottom is not likely to cause substantial problems. However, if the bottom is a heavy muck which must be carefully removed so that settled pollutants will not be diffused into the water, a shovel attachment 236 is attached to the dredging head.

Shovel attachment 236 is a hollow box-like structure, having a loading scoop 239 pointing in a direction C1. It is contemplated that a number of alternatively used attachments will be provided so that the dredge may advance in any direction which is convenient to the local dredging conditions.

The housing 236 affords an opening 240, which fits under the alcove 220, and an apron 242 which covers the front of the alcove when shovel attachment 236 is mounted on dredging head 200. Thus, when attachment 236 is attached to housing 202, the only entrance into alcove 220 is via loading scoop 239. Accordingly, attachment 236 may set in a trench having a depth approximately equal to the height H1 of the loading scoop. If scoop 239 is held against the side of the trench and dragged back and forth, repeated furrows may be plowed. Since the pump impeller 228 is sucking the ambient material into alcove 220, polluted bottom material can be dredged with very little churning and diffusion of the pollutants into the surrounding water.

Figure 13:
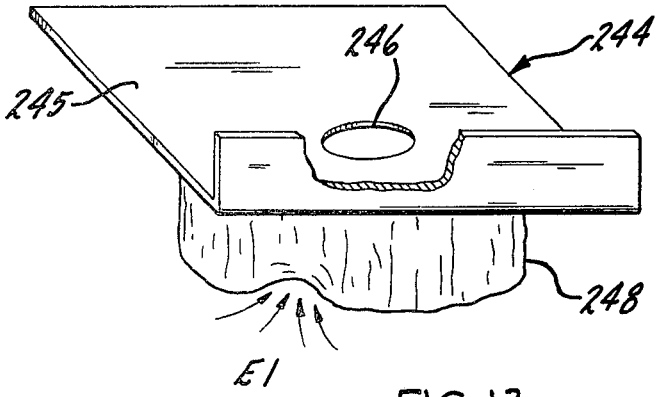
FIG. 13 is a perspective view, partly cut away, of an alternate form of digging chamber for the intake of the dredging head of FIG. 12.

FIG. 13 shows an attachment 244 for dredging head 200 which may be used in lieu of attachment 236. The top plate 245 of attachment 244 is mounted to the front and bottom of housing 202 (FIG. 12) so that the alcove 220 is completely closed except for an intake port 246 provided in plate 245. Dependent from the bottom of the attachment 244 and completely surrounding intake port 246 is a skirt 248 made of rubber, or a similar material. Skirt 248 hangs down to and rests approximately upon the bottom. The pump impeller 228 creates a suction which causes ambient material to be drawn in, under skirt 248, as symbolically indicated by the arrows E1. Skirt 248 sweeps back and forth, as indicated by arrows E1, and material is dredged from a hole which is forming under the area swept by the skirt.

Figure 14:
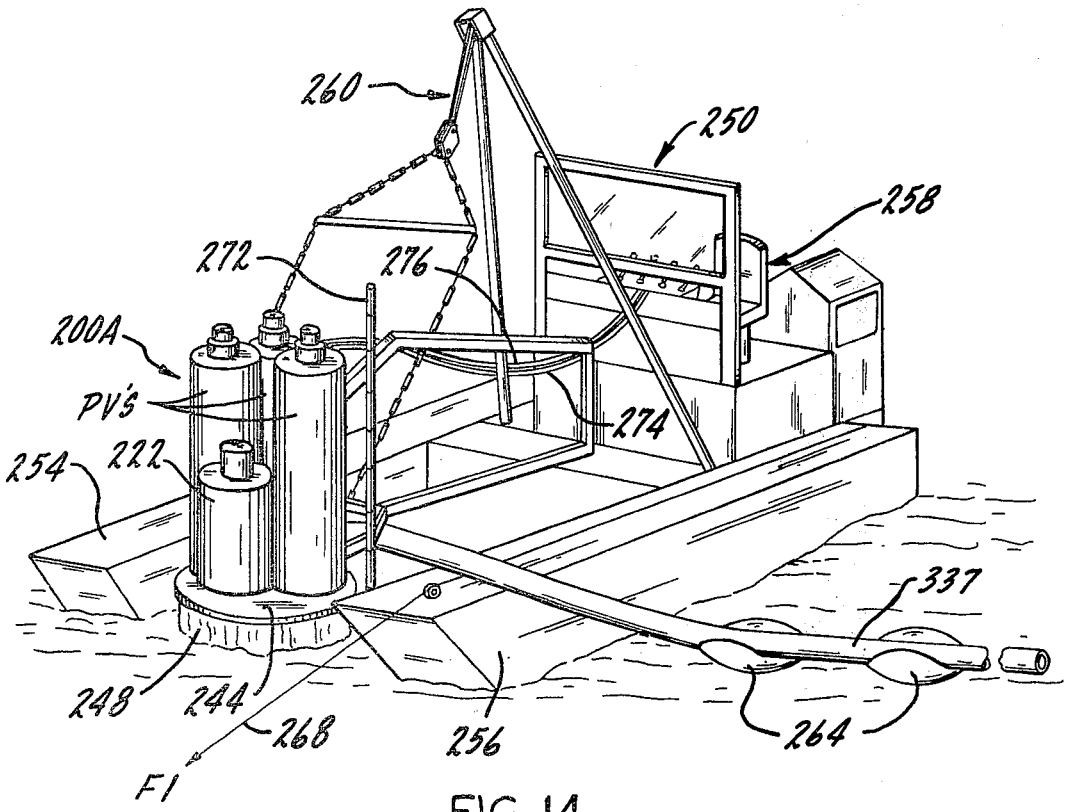
FIG. 14 is a perspective view of a dredging boat or barge for supporting a dredging system according to the invention.

FIG. 14 shows one practical example of a complete dredge 250, and is used to explain how a dredging operation may be conducted.

Dredge 250 includes a dredging boat comprising two spaced parallel pontoons 254 and 256, with a dredging head 200A mounted on one end and a motor and control station 258 mounted on the other end. A suitable derrick or hoist 260 is positioned to raise or lower the dredging head through the space formed between the pontoons 254 and 256. A spoil line 337 is attached to the back of the dredging head. This spoil line rests upon and is supported by suitable floats 264, such as inflated inner tubes 265, which automatically form themselves into a cradle responsive to the weight of the spoil line. A drag line 268 extends out from pontoon 256 and is tied to an anchor located on the land. For example, line 268 may be connected to a post, tree, large rock or any other convenient and suitably stable object.

To initiate the dredging operation, an operator at control station 258 lowers dredging head 200A to a depth marked by a suitable index line on an upright pole 272 mounted on head 200A.

As the bottom is dredged, drag line 268 is reeled in to drag the dredging boat in a desired direction F1, which corresponds to a vector resultant of the forces represented by arrows C1 and D1 in FIG. 12. The operator performs a suitable start operation, and dredging begins. Thereafter, the dredging head functions under automatic control, and dredging continues without requiring the constant supervision of and control by the operator. The material dredged from the bottom is carried off in spoil line 262.

The operations of dredging head 200A are controlled via a number of pneumatic lines 274 and electric lines 276. The electric lines are connected to level sensor probes mounted inside the pressure vessels. One of the probes 278 is shown in FIG. 12 as an elongated, insulated, preferably plastic rod mounted to depend from a cover plate 280 and extend downwardly into the pressure vessel PV12. Suitable electrodes 282 and 284 are formed on rod 278 at levels which match fill and empty levels for the pressure vessel. When the water and other material inside the pressure vessel wets the electrodes 282 or 284, current flows through the water and between the probe electrode and system ground. Thus, water at or above desired upper and lower levels in the pressure vessels is signalled electrically to the control station 258 (FIG. 14).

FIG. 15 is a schematic diagram of a pneumatically operated dredging system control 291 constructed in accordance with another embodiment of the present invention. System 291 controls the pressure vessels PV1–PV3, which may utilize the construction shown in FIGS. 1 and 2 in dredging head 20. Alternatively, pressure vessels PV1–PV3, in the system of FIG. 5, may correspond in construction to those shown in conjunction with dredging head 200, FIGS. 12–14.

Each of the pressure vessels PV1–PV3 includes a material intake port 30 with a check valve 32, a material discharge port 35 with a check valve 38, an air inlet port 89 connected to an air inlet conduit 92, and an air exhaust port 90 connected to an exhaust line 93. Each pressure vessel is provided with a low level exhaust sensor probe 71 and an upper level filled sensor probe 73. Each of the probes 71 and 73 has two electrodes that extend into the pressure vessel so that a conductive path is established between the probe electrodes when they are covered by water and entrained material in the vessel, but that electrical circuit is broken when the water level falls below the probe. The jet blast devices 40 are not shown in FIG. 15 but may be assumed to be present, connected to the system in the same manner as in FIG. 5.

Control 291 comprises three control valves 301A, 301B and 301C, one for each of the pressure vessels PV1–PV3. Each control valve is a four-way momentary contact valve pneumatically actuated by a pilot 302 with a return spring to restore the valve to an OFF condition when there is no pressure at the pilot. The control valves 301A–301C have a construction such that when a pneumatic pressure supply is disconnected from the pilot, but the pilot is not vented, an internal bleed in the valve (not shown) maintains sufficient pressure at the pilot to hold the valve in its actuated ON condition until an exhaust connection is completed to the pilot, at which time the return spring restores the valve to its normal OFF condition.

Each control valve 301A–301C has two outlet ports A and B and two inlet ports C and D. Each inlet port C is connected to a high pressure air supply line 307, whereas each port D is connected to an exhaust line 308 vented to the atmosphere. Port A of each control valve is connected to one of three control lines 309A–309C and each port B is connected to one of three control lines 311A–311C. Control valve 301A is shown in its actuated ON condition, with its ports C and B interconnected to supply air under pressure to line 311A and ports A and D interconnected to vent line 309A to the atmosphere through exhaust line 308. For the unactuated OFF condition of the control valves, as shown for valve 301B, ports A and C are interconnected to supply high pressure air to control line 309B and ports B and D are interconnected to vent line 311B.

In system 291, FIG. 15, there are three start valves 312A–312C, one for each control valve. Each start valve is a two-way solenoid actuated normally open spring-return valve having an inlet port connected to the high pressure air line 307 and an outlet port connected to the pilot 302 of its associated control valve. Each of the three start valves 312A–312C is shown in its actuated closed condition, the condition maintained when the solenoid 313 for the valve is energized, this being the normal operating condition for the start valves. Whenever the solenoid 313 of one of the start valves is de-energized, the return spring for the valve shifts the valve to an open position in which the inlet and outlet ports are interconnected and high pressure air is supplied through the start valve to the pilot of the associated control valve.

Control system 291 further comprises three two-way normally closed pilot release valves 314A–314C each actuated by a pneumatic pilot 315. Each of the pilot release valves is connected between the pilot 302 of an associated control valve and the exhaust line 308. Three normally closed manually actuated pilot release valves 317A–317C are incorporated in system 291, each connected in parallel with one of the pilot release valves.

In control system 291 there are three air inlet valves 319A–319C, one for each pressure vessel. Each inlet valve is a large pilot operated two-way valve having an opening pilot 321 and a closing pilot 322. When an air inlet valve is in open condition, as illustrated for the valve 319A associated with vessel PV1, the valve connects the high pressure air line 307 to the air inlet conduit 92 and hence to the inlet port 89 of the pressure vessel. In closed condition, as shown for the inlet valves 319B and 319C for vessels PV2 and PV3, the air inlet port of the vessel is blocked at the inlet valve. The open pilot 321 of each air inlet valve is connected to the 311 control line from the 301 control valve associated with its pressure vessel. The close pilot of each 319 air inlet valve, on the other hand, is connected to the 311 control line for the control valve associated with an adjacent pressure vessel. Thus, the closing pilot 322 for the inlet valve 319A associated with pressure vessel PV1 is connected to the control line 311B from control valve 301B. The pilot 322 of the inlet valve 319B associated with pressure vessel PV2 is connected to the pneumatic control line 311C, and the closing pilot 322 for the air inlet valve 319C for vessel PV3 is connected to the control line 311A from control valve 301A.

Three exhaust valves 324A–324C are provided in system 291, one for each pressure vessel. Each exhaust valve includes an open pilot 325 and a closed pilot 326. Each exhaust valve has one port connected to the common exhaust line 308 and a second port connected to the conduit 93 that leads to the exhaust port 90 of its pressure vessel. When one of the exhaust valves is open, as shown for the exhaust valve 324C associated with vessel PV3, the exhaust port 90 of the vessel is vented to the atmosphere. When the exhaust valve is closed, as shown for the valves 324A and 324B associated with vessels PV1 and PV2 respectively, the exhaust port 90 of the pressure vessel is blocked.

In system 291, there are three four-way solenoid actuated spring return fill cutoff valves 328A–328C, each operated by a solenoid 329. Each fill cutoff valve has two outlet ports A and B and two inlet ports C and D. Each outlet port A is connected through a check valve 331 to the 311 control line for the 301 control valve associated with the pressure vessel to which the fill cutoff valve relates. Port B of each of the fill cutoff valves 328A–328C is connected to the 309 control line of the associated control valve. Port D for each fill cutoff valve is connected to the open pilot 325 of the associated 324 exhaust valve. The solenoid 329 of each 328 cutoff valve is electrically connected to the upper level fill sensor 73 of its associated pressure vessel.

Three shuttle valves 333A–333C are included in system 291, one for each of the three pressure vessels. Each shuttle valve is a diaphragm-pressure-actuated quick exhaust valve having an inlet port M, an outlet port N, and an exhaust port P. For each of the shuttle valves, the inlet port M is connected to the 311 control line from the 301 control valve for its associated pressure vessel. The outlet port N is connected to the closed pilot 326 of the 324 exhaust valve for the associated pressure vessel. The exhaust port P of each shuttle valve is connected to the inlet port C of the associated 328 fill cutoff valve.

Each of the two level sensor probes 71 and 73 for each pressure vessel in system 291 is electrically connected to a suitable power supply, designated B+. The lower level (discharge) sensor 71 for pressure vessel PV1 is electrically connected to the solenoid 313 for the start valve 312B for pressure vessel PV2 through a normally closed start switch 335B. An indicator lamp 336 is also connected to the probe. Similarly, the lower level probe 71 for vessel PV2 is electrically connected through a start switch 335C to the solenoid 313 for the start valve 312C for pressure vessel PV3. In the same manner, the low level sensor probe 71 for pressure vessel PV3 is connected through a start switch 335A to the solenoid 313 of the start valve 312A for pressure vessel PV1.

In considering the operation of control system 291, FIG. 15, it should be understood that FIG. 15 shows an operating situation in which pressure vessel PV1 is discharging water and entrained material through its outlet port 35 to the spoil line of the dredge (not shown in FIG. 15) with the material level in vessel PV1 at some point intermediate its two sensor probes 71 and 73. Vessel PV2 stands full, at a level above its sensor probe 73. Pressure vessel PV3 is filling, with the water level at some point intermediate its two level sensors 71 and 73. The discharge sequence for the pressure vessels incorporated in system 291 is PV1-PV2-PV3-PV1 . . . . All of the valves are shown in the operating positions that obtain for the situation described.

When the discharge of material from vessel PV1 proceeds far enough so that the water level drops below sensor probe 71 in that vessel, the electrical circuit for the solenoid 313 of start valve 312B for vessel PV2 that is normally maintained through the probe is interrupted. As a consequence, start valve 312B reverts to its open condition and initiates a supply of high pressure air from line 307 to the pilot 302 of control valve 301B. Accordingly, valve 301B is driven from the illustrated OFF condition to its ON condition, in which port C is connected to port B and port D is connected to port A. Accordingly, high pressure air is now supplied to control line 311B and line 309B is vented by connection to the common exhaust line 308.

The high pressure air now present in line 311B is applied to the inlet port M of shuttle valve 333B and through port N to the closing pilot 326 of exhaust valve 324B. This has no present effect because the supply of high pressure air to pilot 326 tends to move valve 324B to its closed position and the valve is already in that condition. However, this action actuates valve 324B to its closed condition if that has not already been accomplished. Thus, closing of the exhaust port 90 of vessel PV2 is effectively assured.

The high pressure air from line 311B is also applied to the opening pilot 321 of the air inlet valve 319B for vessel PV2. The closing pilot 322 of valve 319B is presently vented to the atmosphere through line 311C and control valve 301C. Accordingly, valve 319B is now shifted to its open condition and connects the air supply line 307 to the operating fluid inlet port 89 of vessel PV2. This begins a build-up of pressure in vessel PV2 and initiates discharge of water and entrained material from vessel PV2 through its outlet port 35.

The high pressure air in line 311B is also supplied to the closing pilot 322 of the air inlet valve 319A for pressure vessel PV1. However, at this point there is also high pressure air supplied to the opening pilot 321 of valve 319A, through control valve 301A and line 311A. Thus, there is an equilibrium condition in the pressure supplied to the two pilots 321 and 322 of valve 319A; for the moment, valve 319A remains in its illustrated open condition.

The high pressure air in line 311B is also supplied to the pilot 315 of the pilot release valve 314A for vessel PV1. Accordingly, valve 314A is actuated from its normal closed condition to open condition, venting the pilot 302 of control valve 301A through the common exhaust line 308. This exhausts the trapped pressurized air from pilot 302 and the connecting lines more rapidly than it can be replenished by the internal bleed in valve 301A. Consequently, control valve 301A reverts to its normal OFF condition. Thus, in control valve 301A, port C is now connected to port A to supply air under pressure to line 309A and port D is connected to port B to vent line 311A to the atmosphere through exhaust line 308.

With control line 311A now vented to the atmosphere, the equilibrium condition for air inlet valve 319A is no longer maintained. Valve 319A is driven to its closed condition, effectively closing the inlet port 89 of pressure vessel PV1. High pressure air from line 309A is supplied, through valve 328A, to the opening pilot 325 of the exhaust valve 324A for vessel PV1. Valve 324A opens, effectively venting the exhaust port 90 of vessel PV1 to the atmosphere so that the high pressure which had been maintained in vessel PV1 during discharge is dissipated. In vessel PV1, check valve 38 closes and check valve 32 opens. Pressure vessel PV1 begins to fill with water and entrained debris, due to the hydrostatic pressure of the body of water in which it is immersed.

At this stage, a first phase change has been effected in control system 291. Vessel PV2 has started its discharge phase of operation and, shortly thereafter, vessel PV1 was changed from its discharge phase to its filling phase. As soon as vessel PV1 fills sufficiently to cover the electrodes of the lower level sensing probe 71, the electrical connection to solenoid 313 of start valve 312B is restored and that valve again closes. However, the trapped air in the lines interconnecting valves 312B, 314B, and 317B with pilot 302 of control valve 301B, in conjunction with the internal bleed for valve 301B, maintain that control valve in its ON condition.

Vessel PV3 has been filling, as indicated in FIG. 15, and at some point the water level in the vessel rises above the electrodes of sensor probe 73. This completes an electrical circuit to energize solenoid 329 of the fill cutoff valve 328C for vessel PV3. Valve 328C shifts to its cutoff position so that now high pressure air is present at port C of valve 328C, from line 309C, whereas port D is effectively vented to the atmosphere through line 311C.

Under these circumstances, the pilot 325 of exhaust valve 324C is vented to the atmosphere through port D of valve 328C. High pressure air from port C of valve 328C is supplied to the exhaust port P of shuttle valve 333 and hence to the closing pilot 326 of exhaust valve 324C. Accordingly, valve 324C closes, preventing water and entrained material from flowing out of vessel PV3 into the control system, where it could do substantial damage. Thus, vessel PV3 now stands full, in the operating condition shown in FIG. 15 for vessel PV2, awaiting its turn to discharge. Cutoff valve 328C remains in its closed or cutoff condition until vessel PV3 is subsequently discharged to a level below its probe 73, at which time the solenoid 329 of valve 328C is de-energized.

The next significant action, initiating a changeover to the next phase of operation for system 291, occurs when vessel PV2 has discharged to a level below its probe 71. When this happens, discharge of vessel PV3 is initiated in the same manner as described above for the start of discharge from vessel PV2. Very shortly after vessel PV3 begins to discharge, vessel PV2 is changed over to its fill operation, completing the phase change. When vessel PV3 has completed its discharge phase, vessel PV1 is automatically started in its discharge operation and vessel PV3 is switched over to a filling operation. Thus, operation goes forward in a fully automated sequence PV1-PV2-PV3-PV1 . . . , with one vessel starting discharge just before discharge of another is interrupted, and with that one vessel full and ready to discharge when needed for continuous operation without surging.

The operator of a dredge incorporating system 291 can interrupt dredging at any time by actuating the manual pilot release valve for the pressure vessel currently discharging material. For example, when vessel PV1 is in its discharge phase, as illustrated in FIG. 15, the operator may actuate valve 317A to open condition. This vents the pilot 302 of control valve 301A to the atmosphere through exhaust line 308 and causes valve 301A to revert to its normal OFF condition, supplying high pressure air to control line 309A and venting control line 311A to the atmosphere.

The air pressure from line 309A is supplied, through valve 328A, to the opening pilot 325 of exhaust valve 324A. The closing pilot 326 of valve 324A is vented through shuttle valve 333A, ports M and P, and through cutoff valve 328A, check valve 331, and control line 311A. Consequently, exhaust valve 324A opens. The previously pressurized pilot 321 of inlet valve 319A is now vented to the atmosphere. Valve 319A has a very minor bias (spring, air pressure, or gravity) toward a close condition; it closes. Accordingly, pressure vessel PV1 is changed over from discharge condition to filling condition. This changeover occurs without the level of material in vessel PV1 dropping below the electrodes of sensor 71 so that the changeover of vessel PV2 to discharge condition cannot occur. The sequence of control system 291 is interrupted and dredging operations stop.

After the operator has halted dredging, as described, dredging can be re-initiated simply by actuation of any one of the three start switches 335A–335C. For example, the operator may actuate start switch 335B, interrupting the energizing circuit to solenoid 313 of start valve 312B. This initiates a discharge operation for vessel PV2 in the same manner as described above for opening of the solenoid circuit at probe 71 of vessel PV1.

When the dredging system 291 of FIG. 15 is first placed in operation, and the dredging head comprising pressure vessel PV1–PV3 is submerged, the operator actuates each of the three manual pilot release valves 317A–317C to enable each of the three pressure vessels to fill with material. When at least one pressure vessel is full, which can be determined by suitable indicator lamps 338 energized from the upper level probes 73, the operator actuates the corresponding start switch 335A–335C. This begins the automatic sequence for control 291, which proceeds as described above.

Because there are three pressure vessels in the system, the time required to fill one of the vessels can vary over a substantial range without upsetting system operation. Thus, the fill time can be shorter than the discharge time or it can extend for an interval just slightly less than the time required to discharge the two preceding vessels in the sequence with no major adverse effects upon the system. Unusual conditions of high intake material viscosity, low material pressure (hydrostatic head), or a plug in the intake port of a pressure vessel can cause the filling rate to be reduced to a point at which a changeover may be called for by the system without having a full vessel ready for discharge. A similar imbalance condition may also be caused by accelerated discharge due to an unusual major reduction in discharge resistance or the use of too high a pressure for the operating fluid, in this instance air. Under these circumstances, the operator of system 291 stops the automated sequence by actuation of one of the manual pilot release valves 317A–317C, as described above. Following determination and correction of the cause of the imbalance condition, the operator then restarts the system as described.

It may also happen that a slow discharge cycle can occur for one of the pressure vessels if outlet resistance is unusually great or the operating fluid pressure is too low. This may cause one or more pressure vessels to stand full long enough for heavy material to settle, risking the possibility of formation of a plug in the discharge port 35 for that vessel. However, the construction of the pressure vessels is such that they tend to break up internal plugs as dredged material and operating fluid enter the vessels.

Ideal operation of system 291 (FIG. 15) is attained when each pressure vessel reaches its full condition only a brief interval before that vessel enters its discharge phase; this applies equally to the simplified control 91A of FIG. 5. Discharge timing can be adjusted by regulation of the air pressure supplied to the pressure vessels, an adjustment that the operator can make at the beginning of a dredging operation and that sometimes may be required periodically as dredging goes forward, due to changes of bottom conditions. As long as the pressure is high enough to actuate the valves, no other adjustment of the control systems should be necessary. Of course, the same considerations apply to systems in which the operating fluid is water or other hydraulic fluid instead of air.

Figure 16:
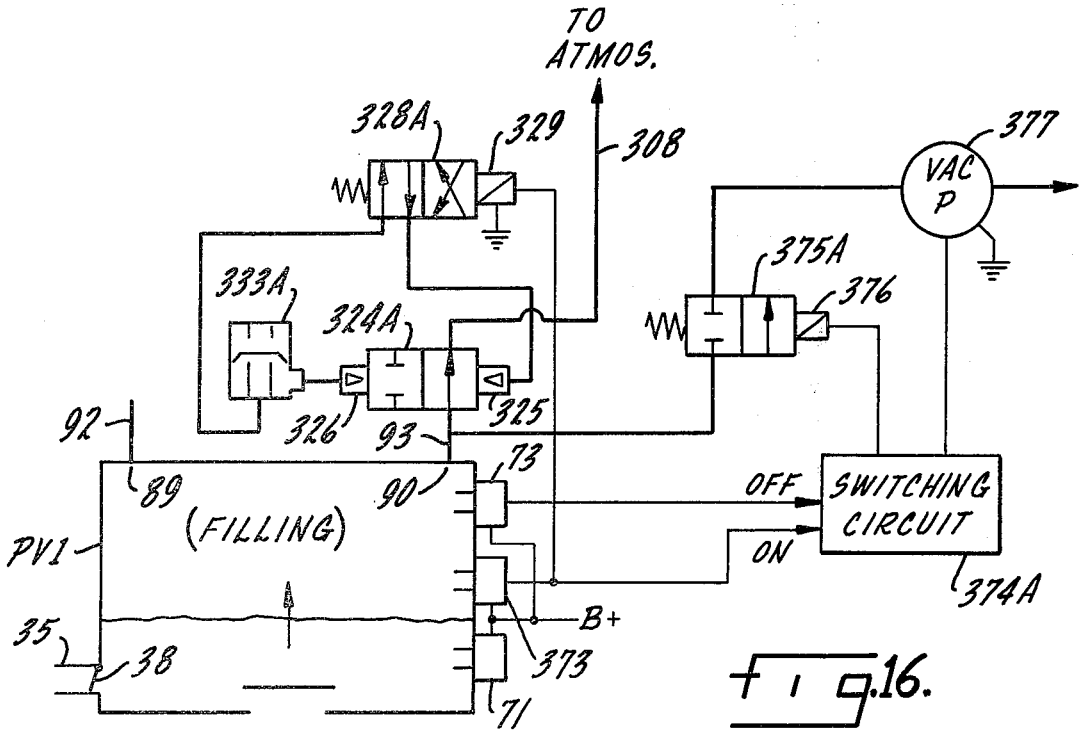
FIG. 16 is a schematic diagram of another embodiment of the invention, particularly adapted for dredging very shallow channels.

In a shallow stream or a shallow swampy body of water, the available hydrostatic head may be inadequate for efficient operation of a pressure displacement dredge of the kind described above, in which filling of the pressure vessels is dependent upon the available head. FIG. 16 illustrates a modification of system 291 of FIG. 15 that may be adopted to allow effective and efficient dredging under conditions in which the hydrostatic head is quite inadequate for normal operation. FIG. 16 shows the modification required for only one pressure vessel, vessel PV1; it should be understood that corresponding modifications are made at the other pressure vessels.

In FIG. 16, pressure vessel PV1 includes a third level sensor probe 373 intermediate the lower and upper level sensors 71 and 73. The electrical connection to the solenoid 329 for fill cutoff valve 328A is changed, that solenoid now being connected to the intermediate sensor 373 instead of to the upper sensor 73. Probes 373 and 73 are each electrically connected to a switching circuit 374A. Switching circuit 374A has one electrical output connected to the solenoid 376 of a two-way vacuum exhaust valve 375A associated with vessel PV1. Another electrical output from switching circuit 374A is connected to a vacuum pump 377. Valve 375A has pneumatic connections to the exhaust line 93 of vessel PV1 and to vacuum pump 377.

In condidering the operation of the system modification shown in FIG. 16, it should be understood that vessel PV1 is illustrated at a point in its operating cycle when the filling operation for the vessel has been initiated and the level of water and entrained material within the vessel is at a point intermediate sensors 71 and 373. The valves of FIG. 16 are all shown in the proper positions for this condition; exhaust valve 324A is open to the atmosphere through the common exhaust line 308 and vacuum exhaust valve 375A is closed. At this stage, the filling operation is proceeding in response to the external hydrostatic head, just as in the previously described embodiments.

When the level of material in pressure vessel PV1 covers the electrodes of sensor 373, that sensor completes an electrical circuit to the solenoid 329 of fill cutoff valve 328A. Valve 328A is actuated to its alternate position to supply pressure to the opening pilot 326 of cutoff valve 324A and to vent the closing pilot 325 of valve 324A in the manner previously described. Accordingly, cutoff valve 324A is actuated to its cutoff position, closing the vent connection for exhaust port 90 as if the vessel PV1 were full.

When covered by water and entrained material in vessel PV1, however, sensor 373 also supplies an actuating ON signal to switching circuit 374A. Accordingly, the switching circuit supplies an energizing signal to the solenoid 376 of vacuum exhaust valve 375A, opening that valve. The switching circuit also energizes vacuum pump 377, which may be common to all of the pressure vessel controls. From this point in the filling cycle, vacuum pump 377 affords a positive exhaust action for the upper portion of vessel PV1, so that additional water and entrained material is sucked into the pressure vessel at a much more rapid rate and to a substantially higher level than could be achieved if only the external hydrostatic head were relied upon.

When the level of material drawn into vessel PV1 reaches the upper level sensor 73, an electrical OFF signal is supplied from the sensor to switching circuit 374A. In response, switching circuit 374A deenergizes the solenoid 376 of vacuum exhaust valve 375A and that valve returns to its normal closed condition, so that water and other debris is not drawn into the valve or into vacuum pump 377. Switching circuit 374A may also deenergize pump 377 unless some other pressure vessel is being filled in its vacuum phase. At this stage, vessel PV1 is filled and is ready for a discharge cycle, just as in the unmodified system 291 of FIG. 15.

The discharge cycle for the system modification shown in FIG. 16 is initiated in the same manner as before, with actuation of the controls to introduce air under pressure through conduit 92 and inlet port 89 into the top of pressure vessel PV1 with exhaust port 90 effectively closed. The resultant discharge of material through port 35 of the vessel first results in a sufficient drop in the material level to expose the electrodes of the upper level sensor 73. Switching circuit 374 is constructed to avoid initiation of a new vacuum pumping cycle at this point, a control function that may be readily arranged by employing a suitable memory circuit such as a conventional flip-flop in the input of the switching circuit. The discharge cycle proceeds in the same manner as in the unmodified circuit of FIG. 15, the uncovering of probe 71 being used to initiate a discharge cycle for the next pressure vessel in the sequence and, shortly thereafter, to begin a new filling phase for vessel PV1. In the new filling phase, the initial intake of water and dredged material proceeds under hydrostatic pressure due to the external head until probe 373 is covered, at which point there is again a changeover to vacuum pumping as described above.

Figure 17:
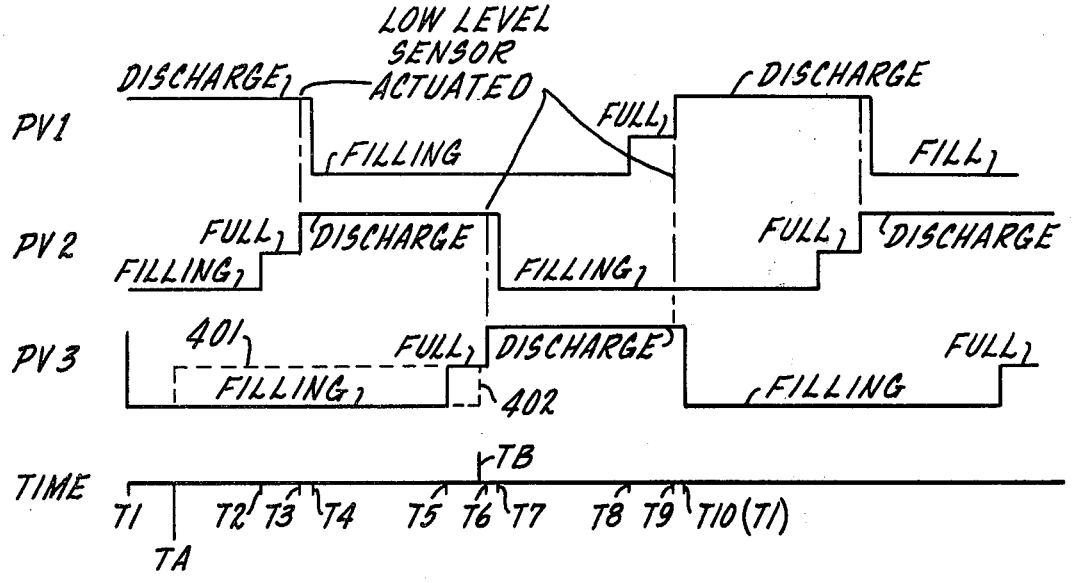
FIG. 17 is a timing chart applicable to the various embodiments of the invention.

FIG. 17 is a timing chart applicable to the systems of the present invention as described above. It assumes that the operating sequence for the system is PV1-PV2-PV3-PV1 . . . and also assumes that at time T1 vessel PV1 has just entered its discharge phase, with vessels PV2 and PV3 both filling.

As operation of the system sequence shown in FIG. 17 proceeds, the first significant change appears at time T2, when vessel PV2 is full. In the preferred embodiments of the system, such as system 291 of FIG. 15, at time T2 the exhaust valve of vessel PV2 is closed to preclude displacement of water and entrained material into the control system. In control system 91A of FIG. 5, no control action takes place at time T2. System 91A relies upon location of the exhaust valves at a height sufficient to avoid the problem of debrisladen water being forced into the exhaust valves and other components of the control system, a less expensive but less reliable expedient.

At time T3 in FIG. 17, the low level sensor for vessel PV1 is uncovered and actuates the cycle control of the system to open the inlet valve for the next vessel PV2 in the sequence and to close the exhaust valve for vessel PV2 if not already closed. Accordingly, at time T3 vessel PV2 begins to discharge. Immediately thereafter, at time T4, the cycle control of the system closes the inlet valve and opens the exhaust valve for vessel PV1 so that vessel PV1 changes over from discharge to its filling phase.

At time T5, vessel PV3 is full. In those systems which employ a high level sensor, the exhaust valve for vessel PV3 is closed at this juncture. At time T6 the low level sensor for vessel PV2 detects the absence of material at its level and actuates the cycle control to begin discharge from vessel PV3. Promptly thereafter, at time T7, vessel PV2 is changed over from discharge to its filling phase.

At time T8 vessel PV1 is full, with the consequences noted above. At time T9 the low level sensor for vessel PV3 is actuated and changes vessel PV1 to its discharge phase. At time T10, almost instantaneously after time T9, vessel PV3 is changed from discharge to filling condition by the cycle control of the system. It will be recognized that time T10 corresponds to time T1 and that the remaining portion of FIG. 17 merely illustrates the beginning of the next cycle of operation.

It is important to note that the filling time for a given vessel, such as the time interval T1-T5 for vessel PV3, can vary over a wide range without major adverse effect upon the effectiveness of the dredging system. Thus, in some circumstances vessel PV3 might reach its full condition at an early point, time TA, as indicated by dash line 401. In other circumstances, the filling time for vessel PV3 might be extended to a time TB, as indicated by dash line 402. This demonstrates the broad range of time relationships acceptable in operation of the systems of the invention, those time relationships being directly related to the depth at which the dredge works (when hydrostatic head is employed to fill the vessels) and the variations that may occur in bottom conditions. For extremely shallow streams and swampy areas, where the filling time would be extended unduly beyond time TB for vessel PV3, the vacuum assist illustrated in FIG. 16 may be employed to bring the dredge within the acceptable functional range. In all of the systems, the control should be such that the next pressure vessel in the sequence is full before changeover to its discharge phase.

As will be apparent from the foregoing description, the dredging and control systems of the present invention are fully automated, once the dredge is in operation, and require no more than minimal attention on the part of the operator. By selection of appropriate operating pressures, the systems may be employed to pump a wide variety of different kinds of materials ranging from ordinary water to heavy viscous materials. Apart from the pressure vessels themselves, the components of the controls are standard commercial items available from a variety of different sources.

The dredging systems of the invention effectively eliminate surging independently of substantial changes in the bottom material being dredged, because the filling time for the pressure vessels can vary over a wide range without producing an adverse imbalance in the systems. Little or no selective modification of the controls, apart from an initial selection of operating pressure, is required. The dredging systems of the invention are quite simple in design and construction and may be made small enough to be fully portable. Nevertheless, the dredging systems of the invention are capable of functioning with only a minimal external pressure head, which for the embodiment of FIG. 16 may even be less than the height of the pressure vessels. Although pneumatically operated systems have been described in detail, it will be apparent that the systems may be employed with water or other hydraulic fluid as the operating fluid, a modification that is quite desirable for dredging in deep bodies of water. The jet blast devices used in the dredging systems of the invention provide material assistance with respect to agitation and digging on the bottom surface and also with respect to acceleration of the intake of material to the pressure vessels. The system of valves used only as sequencing devices in control 291 (e.g. valves 301A–301C, 312A–312C, 317A–317C, 314A–314C, 328A–328C and 333A–333C) can all be replaced by an appropriate electronic sequencing control if desired.

In the vacuum-assisted filling system of FIG. 16, a pressure sensor responsive to a drop in pressure in the pressure vessel PV1 to a pressure slightly above atmospheric can be used instead of the intermediate level sensor 373. With this modification, the changeover to vacuum assisted filling of the pressure vessel occurs as the vessel, vented through exhaust valve 324, to begin its filling phase, experiences a drop to near atmospheric pressure. In all other respects, operation proceeds as described for FIG. 16. Of course, in any vacuum-assisted filling system, a vacuum reservoir (not shown) may also be used in conjunction with pump 377, preferably employing a 100% duty cycle pump.

I claim:

1. A pressure displacement dredging system operable over a wide depth range under varying bottom conditions, comprising:

a submersible dredging head including a plurality of at least three pressure vessels, each vessel having a material intake port and a material discharge port, each material port including a check valve, and each vessel having an operating fluid inlet port and an operating fluid exhaust port, the material discharge ports of all of the vessels being connected to a common material discharge conduit;

a corresponding plurality of low level sensors, one in each pressure vessel;

a source of operating fluid, under pressure;

an inlet valve for each pressure vessel, connecting the inlet port of the vessel to the operating fluid source;

an exhaust valve for the exhaust port of each pressure vessel;

a vacuum pump;

a corresponding plurality of vacuum exhaust valves, each connecting the exhaust port of one of the pressure vessels to the vacuum pump;

and cycle control means coupled to the level sensors and to the inlet, exhaust, and vacuum exhaust valves of all of the vessels in a predetermined closed sequence, the cycle control means being responsive to sensing of the absence of material at the low level sensor in a first vessel to open the inlet valve for the next vessel in the sequence and initiate pressure displacement discharge of material therefrom with no appreciable time delay, and thereafter close the inlet valve and open the exhaust valve of the first vessel to initiate filling of the first vessel by pressure displacement with no appreciable time delay;

the cycle control means further including vacuum changeover means for closing the exhaust valve and opening the vacuum exhaust valve of each pressure vessel during its filling phase to accelerate and complete filling of the vessel when dredging in shallow depths;

the operating sequence being such that each pressure vessel is full when the material in the preceding vessel in the sequence has discharged to the level of its low level sensor.

2. A pressure displacement dredging system according to claim 1 in which the vacuum changeover means comprises a corresponding plurality of intermediate level sensors, each located in one of the pressure vessels at an intermediate level and each coupled to the exhaust valve and the vacuum exhaust valve of that vessel to actuate those valves.

3. A pressure displacement dredging system according to claim 1 in which the vacuum changeover means comprises a corresponding plurality of pressure sensors, each located in one of the pressure vessels and each coupled to the exhaust valve and the vacuum exhaust valve of that vessel to actuate those valves to changeover in response to a drop to a pressure slightly above atmospheric.

4. A pressure displacement dredging system according to claim 2 or claim 3 and in which the cycle control means further comprises a corresponding plurality of upper level sensors, one for each pressure vessel, each located in one of the pressure vessels at an upper level above the intermediate sensor and near the top of the vessel, each upper level sensor being coupled to the vacuum exhaust valve of the associated pressure vessel to close the valve whenever the material in the pressure vessel exceeds the upper level.

5. The improved method of operating a displacement dredge comprising a vacuum pump and a submersible dredging head including a plurality of at least three pressure vessels, each vessel having a material intake port and a material discharge port adjacent its bottom, each material port including a check valve, and each vessel having an operating fluid inlet port and an operating fluid exhaust port vented to the atmosphere, the material discharge ports of all of the vessels being connected to a common material discharge conduit, the dredge further comprising a source of operating fluid, under pressure, connected to all of the fluid inlet ports of the pressure vessels, the operating method including the following sequence of steps:

A. immersing the dredging head in a body of water to be dredged to a lever such that the intake ports of the pressure vessels are located immediately above the bottom of the body of water;

B. venting the pressure vessels to allow them to fill with water and entrained bottom material by hydrostatic pressure of the body of water;

C. opening the inlet port and closing the exhaust port of a first pressure vessel to discharge water and entrained bottom material from that vessel;

D. sensing the drop of material in the first pressure vessel below a low level in that vessel;

E. opening the inlet port of a second pressure vessel in response to step D to initiate discharge from the second vessel;

F. after step E, closing the inlet port and opening the exhaust port of the first vessel, to initiate refilling of the first vessel; and G. repeating steps D, E and F for each pressure vessel in sequence, returning the first pressure vessel to discharge following discharge of the last vessel;

the number of pressure vessels and the operating pressure being selected to assure that each pressure vessel in the sequence is filled at least a short time interval prior to initiation of discharge from that vessel;

the improvement comprising the additional steps of:

F1. sensing the rise of material in the first pressure vessel to an intermediate level above the low level;

F2. closing the vent connection for the exhaust port and connecting the exhaust port of the first vessel to the vacuum pump in response to step F1 to accelerate and complete filling of the vessel;

F3. sensing the rise of material in the first vessel to a level near the top of the vessel, indicating the vessel is full; and F4. disconnecting the exhaust port from the vacuum pump when the first vessel is full.

6. The improved method of operating a pressure displacement dredge comprising a vacuum pump and a submersible dredging head including a plurality of at least three pressure vessels, each having a material intake port and a material discharge port adjacent its bottom, each material port including a check valve, and each vessel having an operating fluid inlet port and an operating fluid exhaust port vented to the atmosphere, the material discharge ports of all of the vessels being connected to a common material discharge conduit, the dredge further comprising a source of operating fluid, under pressure, connected to all of the fluid inlet ports of the pressure vessels, the operating method including the following sequence of steps:

A. immersing the dredging head in a body of water to be dredged to a level such that the intake ports of the pressure vessels are located immediately above the bottom of the body of water;

B. venting the pressure vessels to allow them to fill with water and entrained bottom material by hydrostatic pressure of the body of water;

C. opening the inlet port and closing the exhaust port of a first pressure vessel to discharge water and entrained bottom material from that vessel;

D. sensing the drop of material in the first pressure vessel below a low level in that vessel;

E. opening the inlet port of a second pressure vessel in response to step D to initiate discharge from the second vessel;

F. after step E, closing the inlet port and opening the exhaust port of the first vessel to initiate refilling of the first vessel; and G. repeating steps D, E and F for each pressure vessel in sequence, returning the first pressure vessel to discharge condition following discharge of the last vessel;

the number of pressure vessels and the operating pressure being selected to assure that each pressure vessel in the sequence is filled at least a short time interval prior to initiation of discharge from that vessel;

the improvement comprising the additional steps of:

F1. sensing a drop of pressure in the first pressure vessel to slightly above atmospheric pressure;

F2. closing the vent connection for the exhaust port and connecting the exhaust port of the first vessel to the vacuum pump in response to step F1 to accelerate and complete filling of the vessel;

F3. sensing the rise of material in the first vessel to a level near the top of the vessel, indicating the vessel is full; and F4. disconnecting the exhaust port from the vacuum pump when the first vessel is full.

* * * * *